US007382391B2

(12) United States Patent
Kobayashi

(10) Patent No.: US 7,382,391 B2
(45) Date of Patent: Jun. 3, 2008

(54) LINE HEAD MODULE AND IMAGE FORMING APPARATUS

(75) Inventor: Hidekazu Kobayashi, Toyoshima-machi (JP)

(73) Assignee: Seiko Epson Corporation, Tokyo (JP)

( * ) Notice: Subject to any disclaimer, the term of this patent is extended or adjusted under 35 U.S.C. 154(b) by 339 days.

(21) Appl. No.: 11/211,561

(22) Filed: Aug. 26, 2005

(65) Prior Publication Data

US 2006/0050134 A1 Mar. 9, 2006

(30) Foreign Application Priority Data

Sep. 7, 2004 (JP) ..... 2004-259324
Jul. 8, 2005 (JP) ..... 2005-199715

(51) Int. Cl.
*B41J 2/45* (2006.01)

(52) U.S. Cl. ..... 347/238; 347/130

(58) Field of Classification Search ..... 347/130, 347/134, 135, 238, 137; 257/81
See application file for complete search history.

(56) References Cited

U.S. PATENT DOCUMENTS 6,121,994 A 9/2000 Kuribayashi et al.
6,583,805 B2 * 6/2003 Mashimo et al. ..... 347/241
6,661,445 B2 * 12/2003 Mashimo et al. ..... 347/238
6,816,181 B2 * 11/2004 Ohkubo ..... 347/238
6,825,867 B2 * 11/2004 Koga et al. ..... 347/238
7,020,417 B2 3/2006 Nomura et al.
7,239,337 B2 * 7/2007 Ogihara et al. ..... 347/238
2003/0048351 A1 * 3/2003 Ohkubo ..... 347/238
2004/0089939 A1 * 5/2004 Ogihara et al. ..... 257/690

FOREIGN PATENT DOCUMENTS

CN 1475876 A 2/2004
JP A 11-198433 7/1999

* cited by examiner

*Primary Examiner*—Huan H Tran
(74) *Attorney, Agent, or Firm*—Oliff & Berridge, PLC

(57) ABSTRACT

A line head module faces a photoconductor drum, and is disposed such that light-emitting elements are arranged parallel to a rotational axis of the photoconductor drum to carry out exposure on the photoconductor drum, and the photoconductor drum is rotatably disposed. The line head module includes a line head having the plurality of light-emitting elements, and a condensing lens that condenses light in a direction crossing the arrangement direction of the light-emitting elements between the photoconductor drum and the side of the line head from which light is output.

13 Claims, 16 Drawing Sheets

LINE HEAD MODULE AND IMAGE FORMING APPARATUS

This application claims the benefit of Japanese Patent Application No's. 2004-259324 and 2005-199715 filed Sep. 7, 2004 and Jul. 8, 2005. The entire disclosure of the prior applications is hereby incorporated by reference herein in its entirety.

BACKGROUND

The present invention relates to a line head module used as an exposing unit in an image forming apparatus and to an image forming apparatus having the line head module.

Line printers (image forming apparatus) are known examples of printers using an electrophotographic system. In the line printers, a charging unit, a line-shaped printer head (line head), a developing unit, a transfer unit, etc. are adjacently arranged on a peripheral surface of a photoconductor drum to be exposed. That is, an electrostatic latent image is formed on the peripheral surface of the photoconductor drum charged by the charging unit, as a light-emitting element disposed in the printer head exposes by selectively performing light-emitting operations. Then, the electrostatic latent image is developed by toner supplied from the developing unit, and the developed toner image is transferred to a paper sheet by the transferring unit.

However, a light-emitting diode or the like is generally used as the light-emitting element of the above-described printer head. A light-emitting element array using an organic electroluminescence element (organic EL element) capable of forming a light-emitting point with a good accuracy as the light-emitting element has been developed in recent years, and an image forming apparatus having such a light-emitting element array as an exposing unit has been proposed as well (for example, see Japanese Unexamined Patent Application Publication No. 11-198433).

However, the organic EL element as the light-emitting element cannot satisfy a luminance (amount of light) required to serve as the light-emitting element of the exposing unit in its current state; therefore, it is necessary, in particular, to increase the luminance (amount of light) in the printer head (line head) composed of the light-emitting element array using such organic EL elements.

SUMMARY

An advantage of the invention is that it provides a line head module capable of increasing a luminance (amount of light) of light output from light-emitting elements in order to enhance practicability of a printer head (line head), and an image forming apparatus having this line head module.

The line head module of the invention faces a photoconductor drum which is rotatably disposed, and is disposed such that an arrangement direction of the light-emitting elements is parallel to a rotational axis of the photoconductor drum, in order to carry out exposure on the photoconductor drum. The line hade module includes a line head having a plurality of light-emitting elements arranged therein, a condensing lens that condenses light in a direction crossing the arrangement direction of the light-emitting elements between the photoconductor drum and the side of the line head from which light is output.

According to this line head module, since the condensing lens condenses light only in a direction orthogonal to the arrangement direction of the light-emitting elements, interference of the light emitted from the respective light-emitting elements does not occur between the arranged light-emitting elements by making the light emitted from the respective light-emitting elements permeate through the condensing lens, thereby separately condensing the light. Accordingly, the exposing function is not damaged so that a luminance (amount of light) of the light emitted from the light-emitting elements is enhanced, which thus increase practicability of the line head module as an exposing unit.

In addition, the light-emitting element may be an EL element in the line head module. The EL element such as an organic EL element, for example, has a low luminance (amount of light) as compared with light-emitting diodes. However, the organic EL element can have sufficiently high practicability as the luminance (amount of light) is enhanced by condensing light with the condensing lens as described above.

In addition, each of the light-emitting pixels of the light-emitting elements is preferably formed so as to be longer in a direction crossing the arrangement direction than in the arrangement direction of the light-emitting elements. Specifically, the light-emitting pixel preferably has a rectangular shape. In addition, the condensing lens preferably condenses light emitted from each of the light-emitting pixels on a surface of the photoconductor drum such that the length of the image of light in a direction orthogonal to the arrangement direction of the light-emitting elements is made equal to or less than the length of the image of light in the arrangement direction.

According to this structure, light which is emitted from the respective light-emitting elements and then condensed by the condensing lens, that is, the light condensed on the photoconductor drum have a circular or square shape, or a shape close to the circle or square. Thus the light does not interfere with each other to be condensed on the photoconductor drum with a high density. Accordingly, it is possible to form an accurate image by increasing a resolution. Specifically, when the light-emitting pixel is formed in a rectangular shape to condense light on the photoconductor drum in a substantially rectangular shape, the light-emitting area becomes large so that a large amount of light can be ensured.

In addition, a ratio of the length in the arrangement direction of the light-emitting elements to the length in the direction crossing the arrangement direction of the light-emitting elements is preferably almost the same as a ratio of brightness of the light-emitting pixel to brightness required on the surface of the photoconductor drum. According to this structure, light emitted from the respective light-emitting pixels can be condensed by the condensing lens, whereby a desired brightness (luminance) can be obtained on the photoconductor drum.

In the line head module, each of the light-emitting pixels of the light-emitting elements is preferably formed so as to be longer in a direction substantially orthogonal to the arrangement direction than in the arrangement direction of the light-emitting elements, and the condensing lens preferably condenses light in a direction substantially orthogonal to the arrangement direction of the light-emitting elements. According to this structure, light emitted from all of the arranged light-emitting pixels can be condensed by one condensing lens in the same manner. In addition a width of the condensing lens can be made smallest.

In addition, the line head module preferably includes a lens array composed of lens elements which condense light from the light-emitting elements at the side of the line head from which light is output.

According to this structure, light emitted from the respective light-emitting elements can be better condensed on the photoconductor drum.

The line head module preferably includes the condensing lens between the line head and the lens array, and between the lens array and the photoconductor drum. According to this structure, condensing can be carried out in a more effective manner. In addition, a radius of curvature of the respective condensing lenses can be made large as compared with a case of condensing light by a single condensing lens, thus the condensing lenses can be made thin.

In addition, in the line head module, when the condensing lens is formed in a vault shape in which a surface of the condensing lens facing the photoconductor drum is convex toward the photoconductor drum and a surface of the condensing lens facing the line head is flat, the flat side of the condensing lens is preferably attached to the side of the lens array from which light is output.

According to this structure, since the lens array and the condensing lens are aligned with each other, the line head module including this lens array only needs to be alignment with the photoconductor drum at the time of using. Therefore, the alignment with the photoconductor drum becomes facilitated, which can thus prevent non-uniformity of exposure due to a poor alignment.

In particular, since the flat side of the condensing lens is attached to the lens array, attachment becomes facilitated and the condensing lens and the lens array are integrated, thereby achieving miniaturization on the entire scale.

In addition, in the line head module, when the condensing lens is formed in a vault shape in which a surface of the condensing lens facing the photoconductor drum is convex toward the photoconductor drum and a surface of the condensing lens facing the line head is flat, the flat side of the condensing lens is attached to the side of the lens array from which light is output.

According to this structure, since the line head and the condensing lens are aligned with each other, the line head module only needs to be alignment with the photoconductor drum at the time of using. Therefore, the alignment with the photoconductor drum becomes facilitated, which can thus prevent non-uniformity of exposure due to the poor alignment.

In particular, since the flat side of the condensing lens is attached to the line head, attachment becomes facilitated and the condensing lens and the lens array are integrated, thereby achieving miniaturization on the entire scale.

The image forming apparatus of the invention includes the above-described line head module as an exposing unit.

According to this image forming apparatus, the line head module allows a luminance. (amount of light) of light emitted from the light-emitting elements to be enhanced as described above, practicability of the line head module as the exposing unit is enhanced, which thus improves printing performance of the image forming apparatus and the quality of the printed sheets.

In addition, a line head module of the invention includes a plurality of light-emitting elements arranged to face a photoconductor drum which is rotatably disposed. The light-emitting elements are arranged such that an arrangement direction of the light-emitting elements is parallel to a rotational axis of the photoconductor drum, the condensing lens is disposed at the side of the line head from which light is output, and the light output from the line head condensed by the condensing lens is exposed to the photoconductor drum. In addition, the condensing lens condenses the light output from the line head in a direction crossing the arrangement direction of the light-emitting elements.

BRIEF DESCRIPTION OF THE DRAWINGS

The invention will be described with reference to the accompanying drawings, wherein like numbers reference like elements, and wherein.

DETAILED DESCRIPTION OF EMBODIMENTS

Hereinafter, preferred embodiments of the invention will be described with reference to the accompanying drawings. To better understand the accompanying drawings, dimensions of each component are properly modified so as to be easily shown.

(Line Head Module)

First, a line head module will be described.

Figure 1:
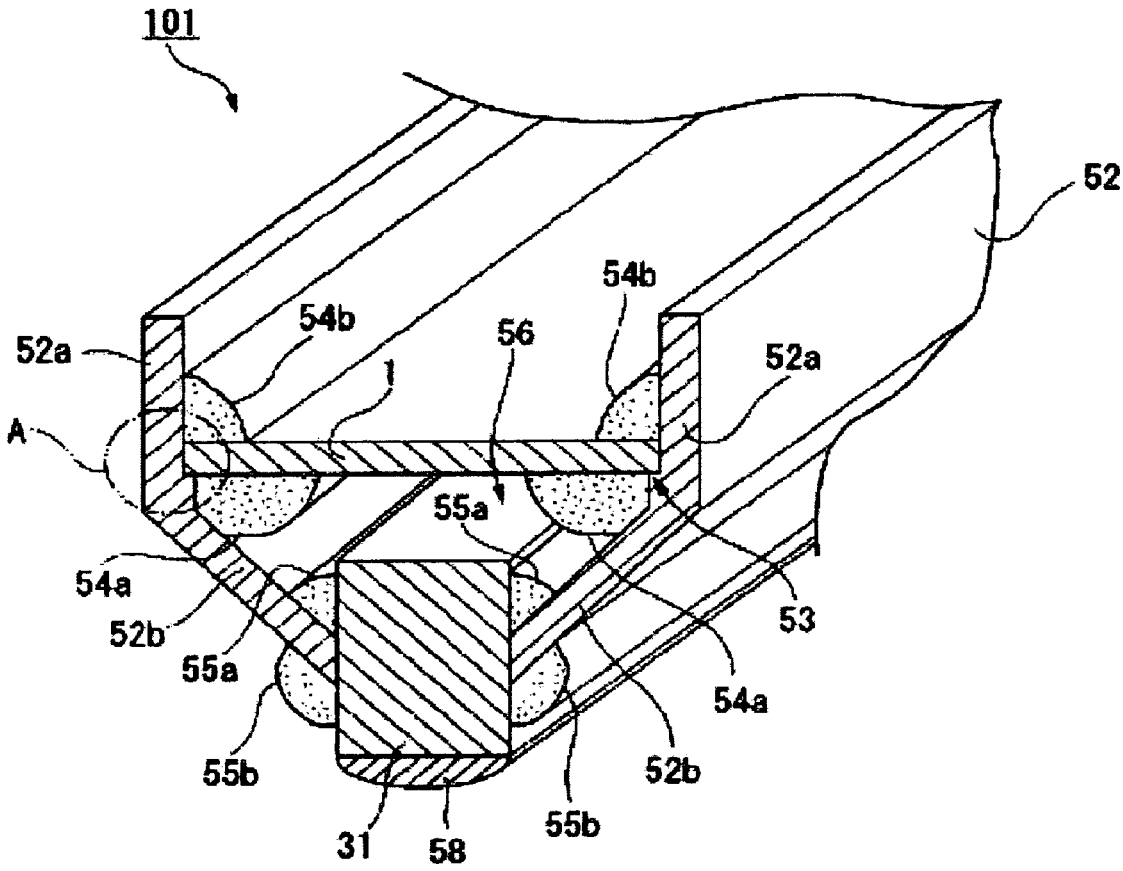
FIG. 1 is a perspective cross-sectional view of a line head module in accordance with an embodiment.

FIG. 1 is a perspective cross-sectional view of a line head module 101 in accordance with an embodiment. The line head module 101 of the embodiment is composed of a line head 1 in which organic EL elements 3 serving as light-emitting elements (See FIG. 2) are arranged, a lens array 31 in which lens elements 31 forming an image of light from the line head 1 are arranged, and a head case 52 supporting a peripheral portion of the lens array 31 and the line head 1. In this case, a condensing lens 58 is attached to a surface of the lens array 31 from which light is output.

The line head 1 and the lens array 31 are supported by the head case 52 while they are aligned with each other, and the lens array 31 and the condensing lens 58 are attached to each other and integrated while they are aligned with each other. The line head 1, the lens array 31, and the condensing lens 58 can be aligned by only having the line head module 101 aligned with the photoconductor drum 9 to be described later (see FIG. 9).

(Line Head)

Figure 2:
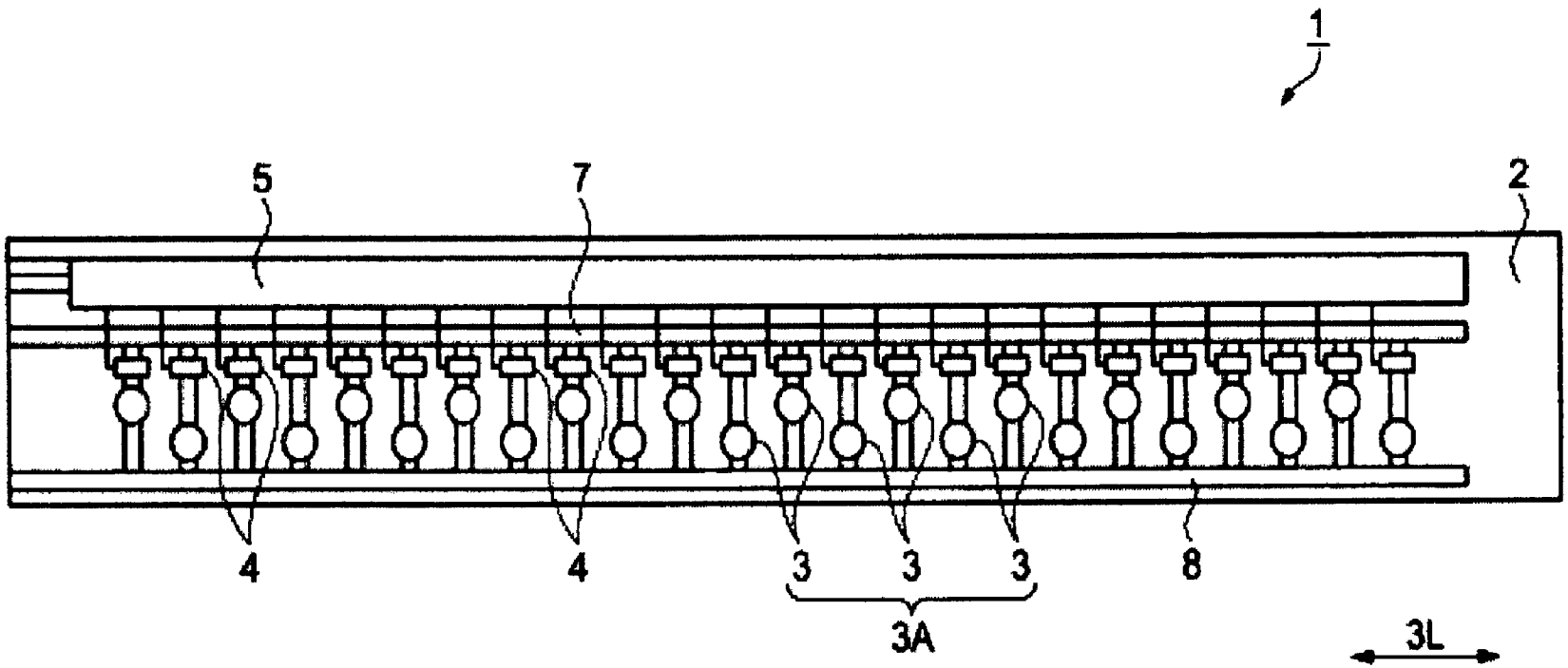
FIG. 2 is a schematic view illustrating a line head.

FIG. 2 is a view schematically illustrating the line head 1. The line head 1 is formed by integrating a light-emitting element line 3A in which a plurality of the organic EL elements 3 is arranged on an elongated rectangular element substrate 2, a group of driver elements composed of driver elements 4 which drive the organic EL elements 3, and a group of control circuits 5 which control the driving of the driver elements 4. The light-emitting element row 3A is arranged in two rows shown in FIG. 2 in an arrangement direction 3L, and the respective organic EL elements 3 are arranged between these light-emitting element rows 3A and 3A in a zigzag manner. The line head 1 having such a construction has a decreased pitch between the organic EL elements 3 when seen from the outside, so that resolution of the image forming apparatus to be described later can be improved.

In addition, a surface of the line head 1 from which light is output is disposed to face the photoconductor drum 9. Here, the arrangement direction 3L of the light-emitting element rows 3A is parallel to a rotational axis of the photoconductor drum 9.

Each of the organic EL elements 3 has at least an organic light-emitting layer between a pair of electrodes, and emits light by supplying an electric current to the light-emitting layer from the pair of electrodes. One electrode of each of the organic EL elements 3 is connected to a power supply line 8, and the other electrode thereof is connected to a power supply line 7 through the driving element 4. The driving element 4 is composed of a switching element such as a thin film transistor (TFT), a thin film diode (TFD), etc. When the TFT is employed as the driving element 4, the power supply line 8 is connected to the source region of the TFT, and the group of control circuits 5 is connected to a gate electrode of the TFT. Then, the driving of the driving element 4 is controlled by the group of control circuits 5, and supply of a current to the organic EL element 3 is controlled by the driving element 4.

The structure and manufacturing method of the organic EL element 3 and the driving element 4 will be described below in detail. In addition, the organic EL element 3 is employed as the EL element in the line head 1, however, an inorganic EL element may be employed instead.

(Lens Array)

Figure 3:
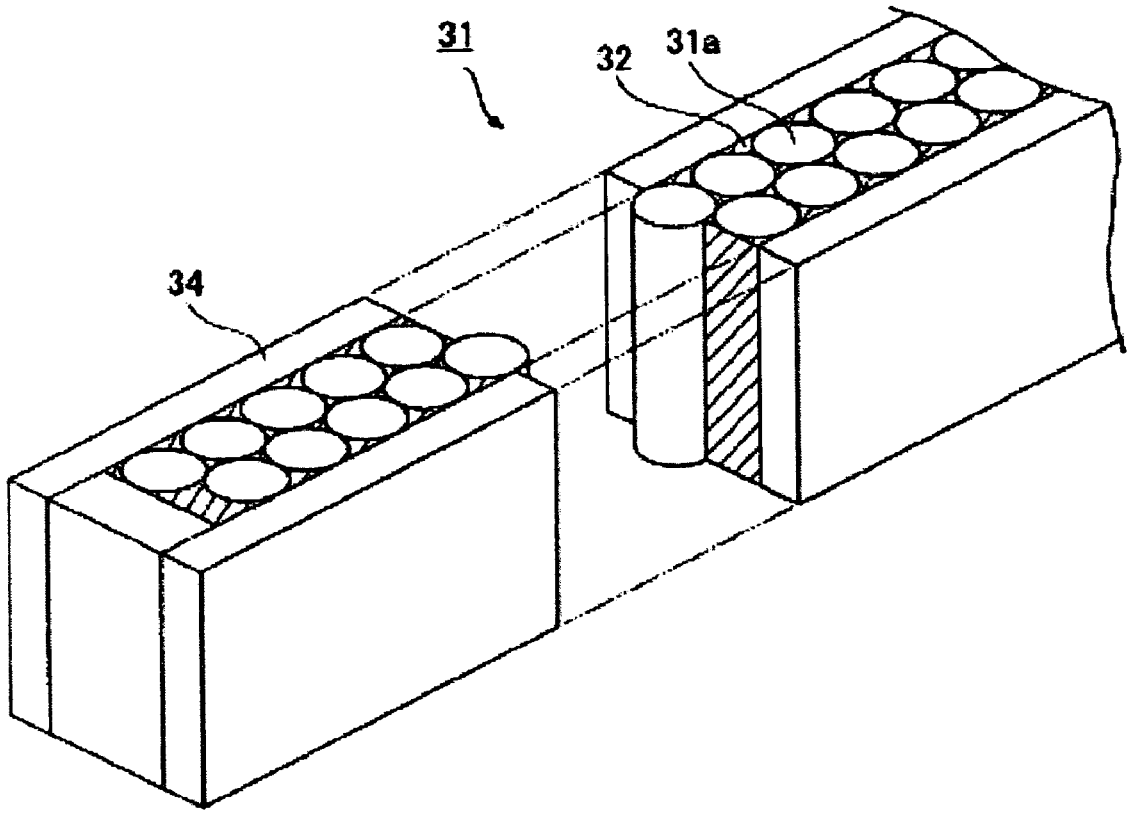
FIG. 3 is a perspective view illustrating a lens array.

FIG. 3 is a perspective view illustrating the lens array 31. The lens array 31 is, for example, composed of a SELFOC (trademark) lens array (manufactured by Nippon Sheet Glass Co., Ltd.), and SELFOC lens elements or SL elements 3 la having the same structure as the SELFOC lens elements are arranged in two rows in a zigzag manner. In addition, a black silicon resin 32 is filled in a gap between the SL elements 31*a* arranged in the zigzag manner, and frames 34 are disposed around the elements. Here, the SL elements 31*a* form cylindrical lens arrays with which an image is formed as a nonmagnified erect image. Since such SL elements 31*a* can be arranged in two rows in the zigzag manner, the lens array 31 can form a wide range of images. In addition, the lens array 31 is not limited to the SELFOC lens array, but various examples may be used as long as the lens array is constituted by arranging lens elements forming an image of light from the organic EL elements 3 (light-emitting element).

(Condensing Lens)

Figure 4A:
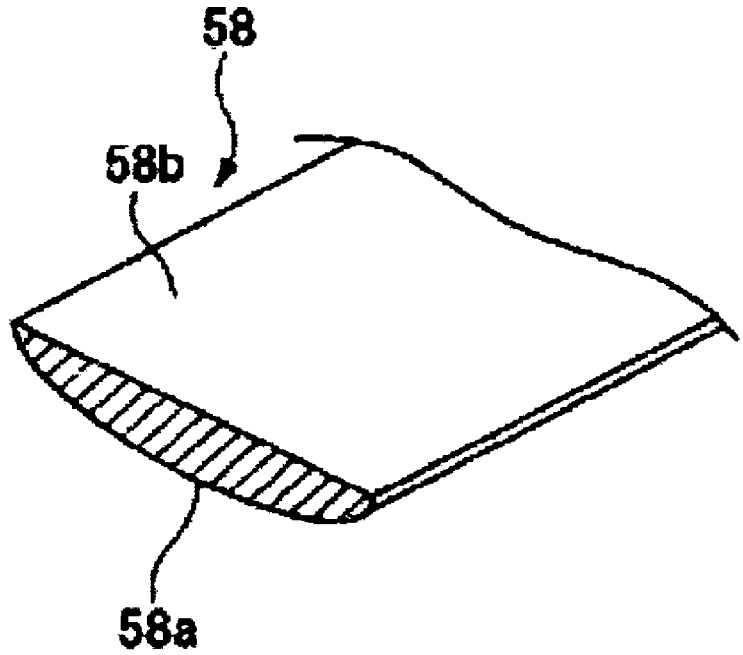
FIGS. 4A and 4B are perspective views illustrating a main part of a condensing lens.

FIG. 4A is a perspective view illustrating the condensing lens 58. This condensing lens 58 is disposed at a side of the line head 1 from which light is output, and is disposed between the line head 1 and the photoconductor drum 9 to be described later. The condensing lens 58 is attached to the side of the line head 1 from which light is output as described above in the embodiment. In addition, the condensing lens 58 condenses light only in a direction orthogonal to a row direction of the light-emitting element row 3A. A surface of the condensing lens 58 facing the photoconductor drum 9 to be described later is formed into a curved surface 58*a* which is convex toward the photoconductor drum 9, and a surface of the condensing lens 58 facing the line head is formed into a flat surface 58*b*.

That is, the condensing lens 58 is a cylindrical lens formed in a vault shape, and the flat surface 58*b* is attached to the surface (plane) of the lens array 31 from which light is output by means of, for example, a transparent adhesive. In addition, the curved surface 58*a* is formed such that it is bent and swollen toward its center from its side end. However, the curved surface 58*a* is bent only in a direction orthogonal to a longitudinal direction (axial direction) of the condensing lens 58, and is not bent in the longitudinal direction so that the surface has a linear shape in the longitudinal direction. In addition, the condensing lens 58 having such a construction condenses light only in a direction orthogonal to the longitudinal direction (axial direction) and does not condense light in the longitudinal direction. Accordingly, the longitudinal direction of the condensing lens 58 is disposed to coincide with the arrangement direction 3L of the light-emitting element row 3A in the line head 1, so that the condensing lens condenses light only in a direction orthogonal to the row direction of the light-emitting element row 3A as described above.

In addition, the condensing lens 58 is attached such that its longitudinal direction coincides with the arrangement direction of the SL elements 31*a* in the lens array 31. In addition, by attaching the flat surface 58*b* of the condensing lens 58 to the lens array 31, the plane of the lens array 31 is brought into contact with the flat surface of the condensing lens 58, whereby the surfaces are closely joined to each other in an easy manner. Accordingly, the alignment between the condensing lens and the lens array is facilitated.

Figure 4B:
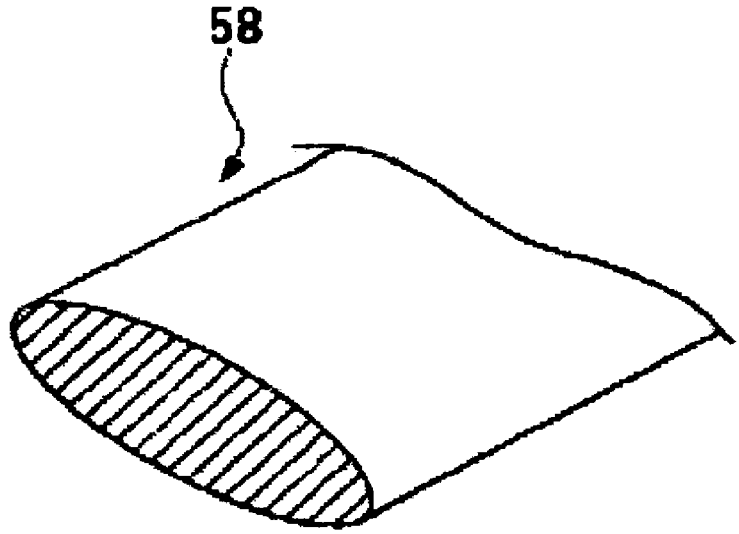

In addition, the condensing lens 58 is not limited to the above-described vault shape but various shapes may be employed in the embodiment as long as the condensing lens condenses light only in a direction orthogonal to the row direction of the light-emitting element row 3A and does not condense light in the row direction of the light-emitting elements 3A. For example, it may have a spindle shape as shown in FIG. 4B, that is, it may have a cylindrical shape having its both ends thin and pointed. However, in a case of the spindle shape, both surfaces of the spindle shape, that is, side surfaces orbiting the central axis are curved, so that they are not easily attached to the lens array 31. Accordingly, they are not directly attached to the lens array 31 or the lines head 1 but are attached to, for example, a head case 52 so that the alignment with the lens array 31 or the line head 1 is preferably carried out.

(Head Case)

Returning to FIG. 1, the head case 52 according to this embodiment will be described. The head case 52 supports the outer periphery of the line head 1 and the lens array 31 in the line head module 101. The head case 52 is made of rigid materials such as Al in a slit shape. A cross-section perpendicular to a longitudinal direction of the head case 52 has both a top and a bottom end thereof opened, upper side walls 52*a* and 52*a* are disposed parallel to each other, and lower side walls 52*b* and 52*b* are respectively disposed inclined to the center of the lower side thereof. In addition, although not shown, side walls of both ends in the longitudinal direction of the head case 52 are disposed parallel to each other as well.

The aforementioned line head 1 is disposed inside of the upper sidewalls 52*a* of the head case 52.

Figure 5:
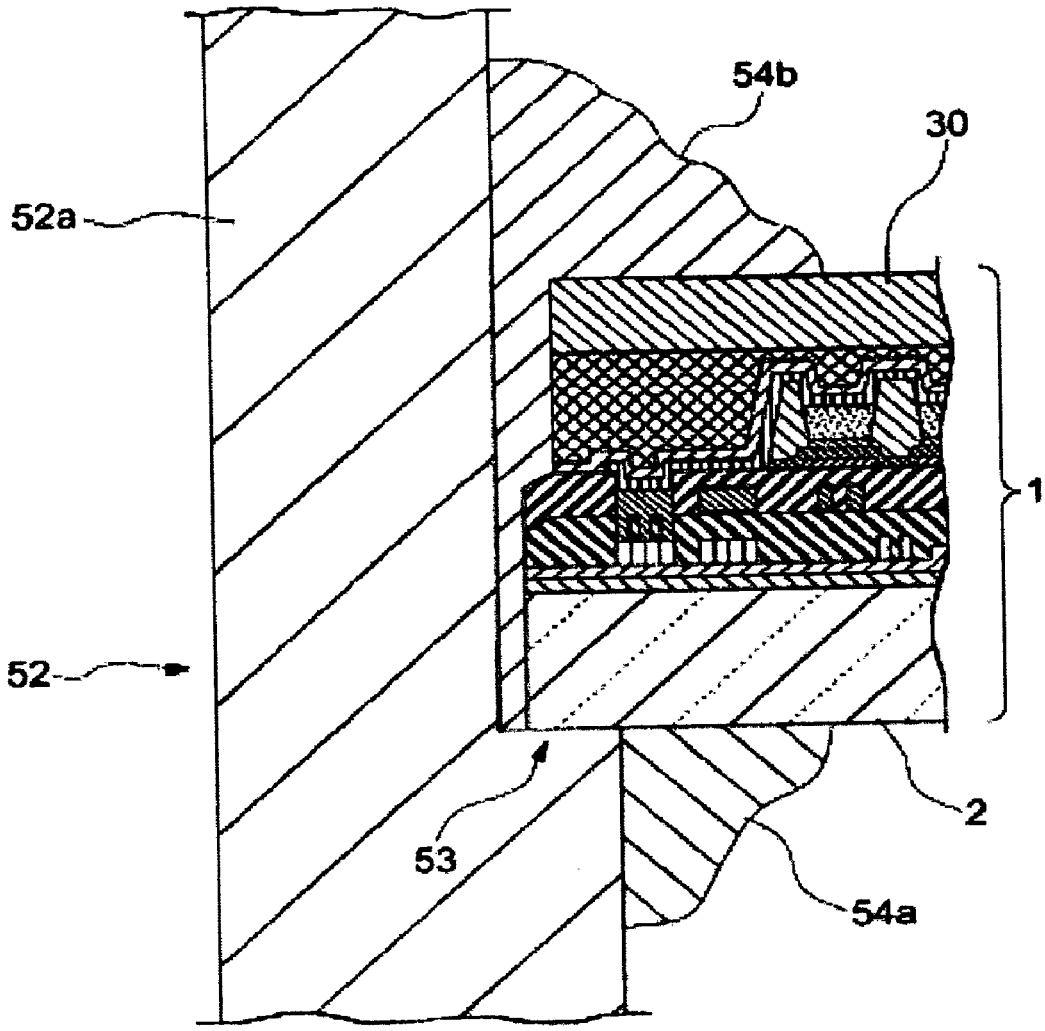
FIG. 5 is an enlarged view illustrating a line head at a connecting portion.

FIG. 5 is an enlarged view showing a coupled portion (portion A in FIG. 1) of the line head. As shown in FIG. 5, a stepped seat 53 is formed along the entire periphery on an inner surface of the sidewalls 52*a* of the head case 52. A lower surface of the line head 1 abuts on an upper surface of the seat 53, so that the line head 1 is horizontally disposed. Although to be described below in detail, the line head 1 is of a bottom emission type, and the element substrate 2 is disposed downward and a sealing substrate 30 is disposed upward.

Sealing materials 54*a* and 54*b* are disposed along the entire periphery of each corner formed by the sidewalls 52*a* of the head case 52 and the line head 1. A sealing material is also disposed in the gaps between the inner surface of the sidewalls 52*a* of the head case 52 and the side surfaces of the line head 1. In this manner, the line head 1 is airtightly joined with the head case 52. Among these sealing materials, the sealing material 54*b* disposed on the upper surface of the line head 1 is made of UV curable resin such as acryl. The sealing material 54*a* disposed on the lower surface of the line head 1 is made of thermosetting resin such as an epoxy.

The sealing materials 54*a* and 54*b* may contain getter agent. The getter agent is a drying agent or deoxidant and absorbs moisture or oxygen. By this construction, it is possible to reliably block out permeation of moisture or oxygen. Therefore, moisture absorption and oxidization of the organic EL element 3 formed in the line head 1 can be suppressed, thereby preventing the deterioration of durability and the short lifetime of the organic EL element 3.

Returning to FIG. 1, the lens array 31 is disposed at a slit shaped aperture formed at the lower end of the head case 52. Each corner formed by the sidewalls 52*b* of the head case 52 and the lens array 31 has the sealing materials 55*a* and 55*b* disposed over its entire periphery. A sealing material is also disposed in gaps between the inner surface of the sidewalls 52*a* of the head case 52 and the sidewalls of the line head 1. In this way, the lens array 31 is airtightly joined with the head case 52. Among these sealing materials, the sealing material 55*a* disposed on the lens array 31 is made of thermosetting resin such as an epoxy. The sealing material 55*b* disposed beneath the lens array 31 is made of UV curable resin such as acryl. The sealing materials 55*a* and 55*b* may contain getter agent.

A first chamber 56 is formed between the line head 1 and the lens array 31 in the head case 52. As described above, since the line head 1 and the lens array 31 are airtightly joined with the head case 52, the first chamber 56 is sealed. The inside of the first chamber 56 is filled with an inert gas such as nitrogen gas or remains a vacuum.

(Manufacturing Method of Line Head Module)

Hereinafter the manufacturing method of the line head module 101 of the embodiment will be described with reference to FIG. 1. First, the sealing material 54*a* made of thermosetting resin is applied to the entire periphery of the inner surface of the head case 52, along the seat 53 formed on the inner surface of the upper sidewalls 52*a* of the head case 52. Then, the line head 1 is inserted into the head case 52 so as to be disposed on the upper surface of the seat 53. In this case, the sealing material 54*a* applied along the seat 53 flows so as to be relocated in each corner of the inner surface of the head case 52 and the lower surface of the line head 1.

The line head is formed in an elongated rectangular shape, and thus the line head 1 can be easily bent. Therefore, a flatness of the line head 1 can be ensured if needed. Next, the sealing material 54*b* made of UV curable resin is applied on the entire periphery of the line head 1 along each corner of the inner surface of the head case 52 and the lower surface of the line head 1. Next, a UV spot is irradiated onto the sealing material 54*b* at predetermined intervals, and thus the sealing material 54*b* is partially hardened, thereby temporarily fixing the line head 1.

Next, the head case 52 is put into a treatment room of ambient atmosphere, and the following process is performed in the treatment room. The sealing material 55*a* made of thermosetting resin is applied along the entire periphery of the inner surface of the head case 52 along an aperture of the lower end of the head case 52. In addition, the sealing material 55*a* can be applied along the aperture of the lower end as well as the sealing material 54*a* being applied along the seat 53. Then, the lens array 31 is inserted into the aperture of the lower end of the head case 52. In this case, the sealing material 55*a* applied along the aperture of the lower end flows so as to be relocated in each corner of the inner surface of the head case 52 and the lower surface of the line head 1.

At this time, the lens array 31 is relatively positioned with respect to the line head 1, that is, relatively aligned with the line head 1. The alignment method is not specifically limited. For example, while the state of an image formed by the lens array 31 is checked by causing the organic EL elements 3 of the line head 1 to emit light, both of the lens array 31 and the line head 1 are aligned with each other. At this time, the light-emitting line of the line head 1, that is, a center line of the light-emitting element row 3A constituted by arranging the organic EL elements 3 is made to be aligned with the center line of the lens array 31.

Next, the sealing material 55*b* made of a UV curable resin is applied to the entire periphery of the lens array 31 along each part of an outer surface of the head case 52 and a side surface of the lens array 31. Next, a UV spot is irradiated on the sealing material 55*b* at predetermined intervals, and thus the sealing material 55*b* is partially hardened, thereby temporarily fixing the lens array 31.

Then, the entire line head module 101 is heated to about 50° C. in a heating furnace. Accordingly, the entire sealing materials 54*a* and 55*a* made of thermosetting resin are hardened. Next, ultraviolet rays are irradiated on the entire line head module 101. Therefore, the entire sealing materials 54*b* and 55*b* made of UV curable resin are hardened. In addition, the process order can be reversed, so that the hardening of the sealing materials 54*a* and 55*a* made of thermosetting resin may follow the hardening of the sealing materials 54*b* and 55*b* made of a UV curable resin.

Next, the condensing lens 58 is attached to an outer surface of the lens array 31 while the lens is aligned with the lens array 31. In this case, the alignment of the condensing lens 58 with respect to the lens array 31 actually means its alignment with respect to the line head 1, that is, an arrangement direction 3L (center line) of the light-emitting element row 3A in the line head 1 is made to coincide with the central axis which extends in the longitudinal direction of the condensing lens 58. Accordingly, as described above, the condensing lens 58 is not indirectly aligned with the lens array 31 but can be directly aligned with the line head 1.

In addition, the attachment is carried out by using, for example, transparent thermosetting resin or transparent UV curable resin. Alternatively, attachment of the condensing lens 58 to the lens array 31 is not be carried out after the lens array 31 is fixed on the head case 52, but the condensing lens 58 is attached to the lens array 31 in advance and the joined condensing lens 58 and the lens array 31 is attached and fixed to the head case 52.

By means of this structure, the line head 1 is airtightly joined with the head case 52 by the sealing materials 54*a* and 54*b* while the lens array 31 is airtightly joined with the head case 52 by the sealing materials 55*a* and 55*b*, and the condensing lens 58 is attached to the lens array 31. In addition, the chamber 56 formed between the lens array 31 and the line head 1 is sealed and the inside of the chamber 56 is filled with nitrogen gas.

Therefore, in the line head module 101 of this embodiment, moisture and oxygen can be prevented from getting access to the line head 1 from the lens array 31. Accordingly, moisture absorption and oxidization of the organic EL elements 3 can be suppressed, thereby preventing deterioration of durability and a short lifetime of the organic EL elements. As a matter of course, the line head module initially having the same characteristics can be assembled even when assembly is not carried out under a circumstances such as an inert atmosphere as shown in this embodiment.

(Organic EL Element and Driving Element)

Hereinafter, the construction of the organic EL element 3 and the driving element 4 in the line head 1 will be described in detail with reference to FIGS. 6A and 6B.

In the case of a so-called bottom emission type which outputs light emitted from a light-emitting layer 60 from a pixel electrode 23, since it is constructed such that the emitted light is extracted from the element substrate 2, a transparent or semi-transparent element substrate 2 is used. For example, glass, quartz, resin (plastic, plastic film), etc. can be used, in particular, a glass substrate is preferably used.

In addition, in case of a so-called top emission type which outputs light emitted from the light-emitting layer 60 from a negative electrode (the counter electrode) 50, since it is constructed such that the emitted light is extracted from a sealing substrate facing the element substrate 2, any one of a transparent or semi-transparent substrate can be used as the element substrate 2. For example, thermosetting resin, thermoplastic resin or the like can be used as a semi-transparent substrate other than ceramics such as alumina and metal sheets such as stainless steel in which insulation-treatment such as surface oxidization is performed.

The bottom emission type is employed in this embodiment, and thus transparent glass is used as the element substrate 2.

A circuit part 11 including a TFT 123 (driving element 4) for driving to be connected to a pixel electrode 23 is formed on the element substrate 2, and the organic EL element 3 is formed on the circuit part 11. The organic EL element 3 is constructed such that the pixel electrode 23 which functions as both electrodes, holes transporting layer 70 which injects/transports holes from the pixel electrode 23, the light-emitting layer 60 made of organic EL materials, and the negative electrode 50 are formed in this order.

Figure 6A:
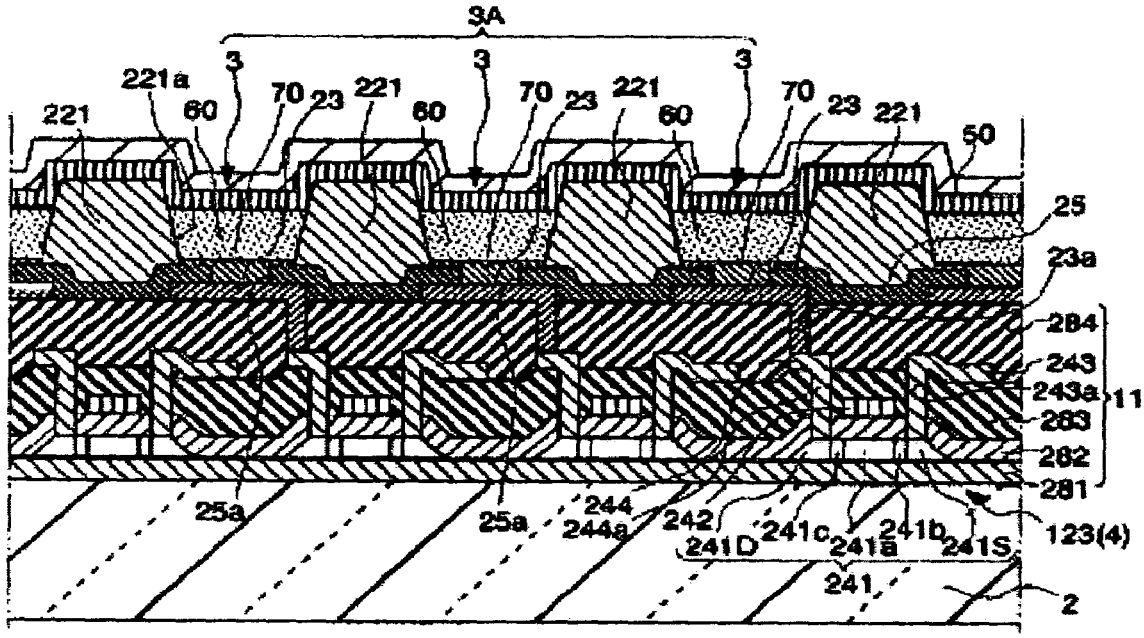
FIG. 6A is a cross-sectional view illustrating a main part of a line head, and 6B is a schematic view thereof.
Figure 6B:
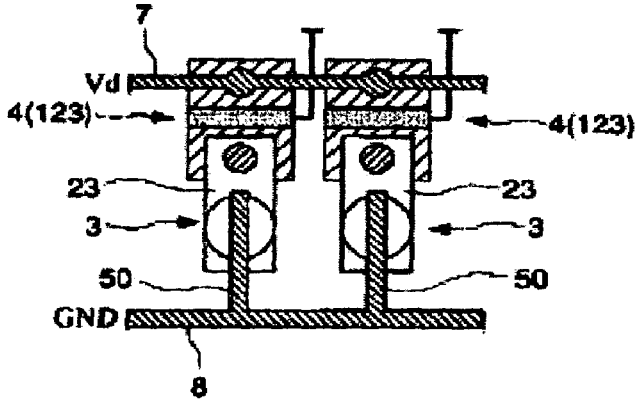

Here, FIG. 6B schematically shows the organic EL element 3 and the TFT 123 (driving element 4) for driving corresponding to FIG. 2. In FIG. 6B, the power supply line 7 is connected to a source/drain electrode of the driving element 4, and the power supply line 8 is connected to the negative electrode 50 of the organic EL element 3.

In the above construction, the organic EL element 3 is designed to emit light when a hole injected from the hole transporting layer 70 is combined with an electron from the negative electrode 50 in the light-emitting layer 60, as shown in FIG. 6A.

If the pixel electrode 23 which functions as both electrodes is, in particular, of the bottom emission type, the pixel electrode 23 is formed of a transparent conductive material, specifically, ITO is preferred.

As materials form the hole transporting layer 70, in particular, dispersion liquid of 3,4-polyethylene deoxythiophene/polystyrenesulfonic acid (PEDOT/PSS), that is, dispersion liquid made as 3,4-polyethylene deoxythiophene dispersed in polystyrenesulfonic acid serving as a dispersion medium and then further dispersed in water is preferably used.

In addition, the materials that form the hole transporting layer 70 are not limited to the above-mentioned materials. For example, polystyrene, polypyrrole, polyaniline, polyacetylene or their derivatives dispersed in the appropriate dispersion medium, for example, the polystyrenesulfonic acid may be used.

Known light-emitting materials, which emit fluorescence or phosphorescence, are used as materials which form the light-emitting layer 60. For example, although light-emitting layers corresponding to red color for the emission wavelength band are adopted in this embodiment, the light-emitting layers may correspond to green or blue color. In this case, the photoconductor to be used has sensitivity to the light-emitting region.

Materials including (poly)fluorene (PF) derivative, (poly) paraphenylenevinylene (PPV) derivative, polyphenylene (PP) derivative, polyparaphenylene (PPP) derivative, polyvinylcarbazole (PVK) derivative, polythiophene derivative, polysilane such as polymethylphenylsilane (PMPS) derivative, and the like as a material for forming the light-emitting layer 60 are properly used. Polymeric materials such as perylene dye, coumarin dye, rhodamine dye and low molecular weight materials such as rubrene, perylene, 9,10-diphenylanthracene, tetraphenyl butadiene, nile red, coumarin 6, and quinacridone can be doped so as to be used.

The negative electrode 50 is formed by covering the light-emitting layer 60. For example, Ca is formed with the thickness of 20 nm, and Al is formed on the Ca with the thickness of 200 nm to form an electrode having a laminated-layer structure, and Al also functions as a reflective layer.

Furthermore, a sealing substrate (not shown) is adhered on the negative electrode 50 sandwiching an adhesion layer therebetween.

In this case, the organic EL element 3 composed of the pixel electrode 23, the hole transporting layer 70, the light-emitting layer 60, and the negative electrode 50 has a region in which, in particular, the hole transporting layer 70 and the light-emitting layer 60 are formed, that is, a region defined by the shape of the aperture 25*a* of the organic partition wall 70 to be described later, serves as a region emitting light, that is, the light-emitting pixel 25*b* (see FIG. 7). In addition, in this embodiment, the light-emitting pixel 25*b* (that is, light-emitting region) is formed so as to be longer in a direction orthogonal to the arrangement direction of the organic EL element 3 than in the arrangement direction.

Figure 7A:
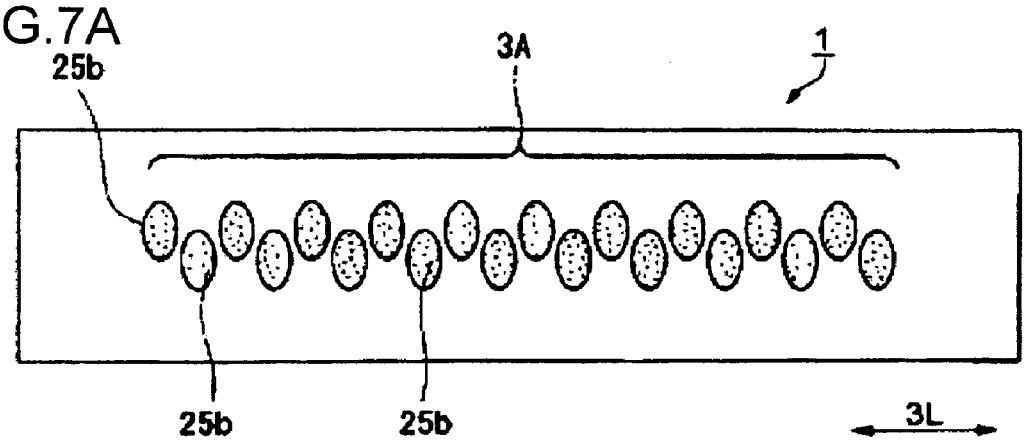
FIGS. 7A to 7C are views for explaining shape and arrangement of light-emitting pixels.
Figure 7B:
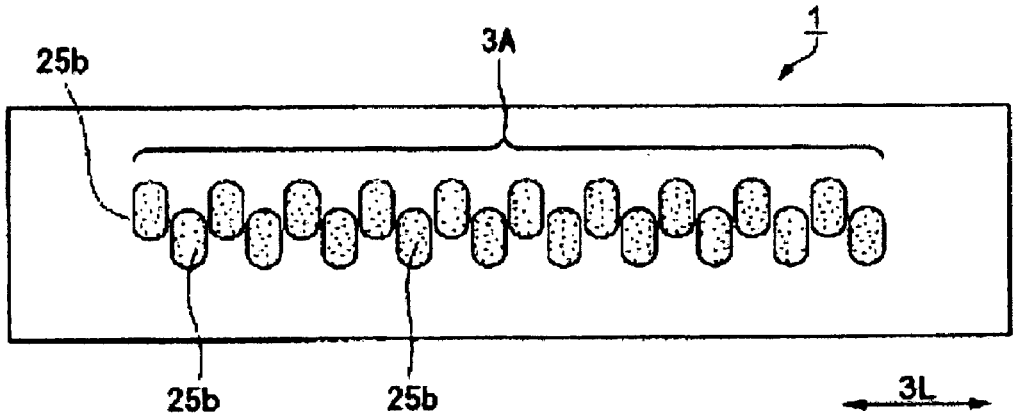
Figure 7C:
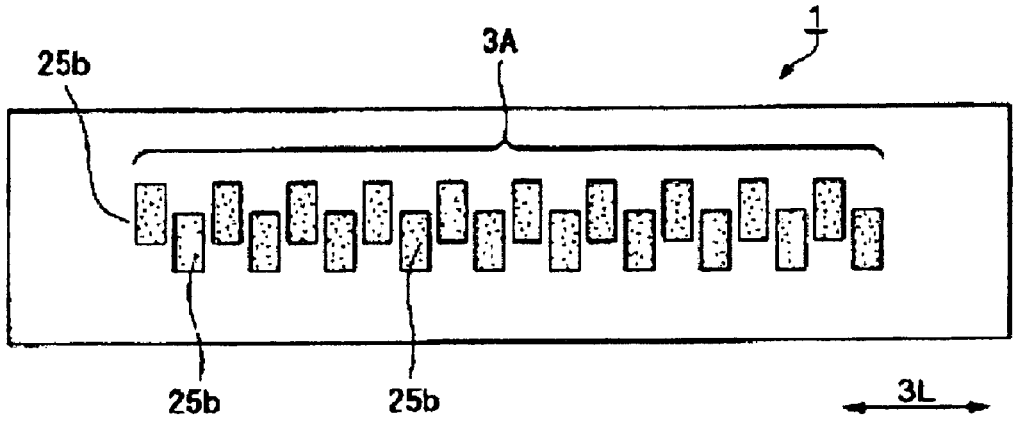

Specifically, as shown in FIG. 7A, each of the light-emitting pixels 25*b* has, for example, an elliptical shape and is arranged such that a longitudinal direction of the short axis coincides with the arrangement direction 3L of the organic EL elements 3 and a longitudinal direction of the long axis is orthogonal to the arrangement direction 3L. Furthermore, each light-emitting pixel 25*b* may have a long barrel shape as shown in FIG. 7B or a rectangular shape as shown in FIG. 7C. Specifically, when the light-emitting pixel 25*b* has a rectangular shape to cause light to be condensed in a substantially square shape on the photoconductor drum 9, the light-emitting area increases so that a large amount of light can be ensured.

Figure 8A:
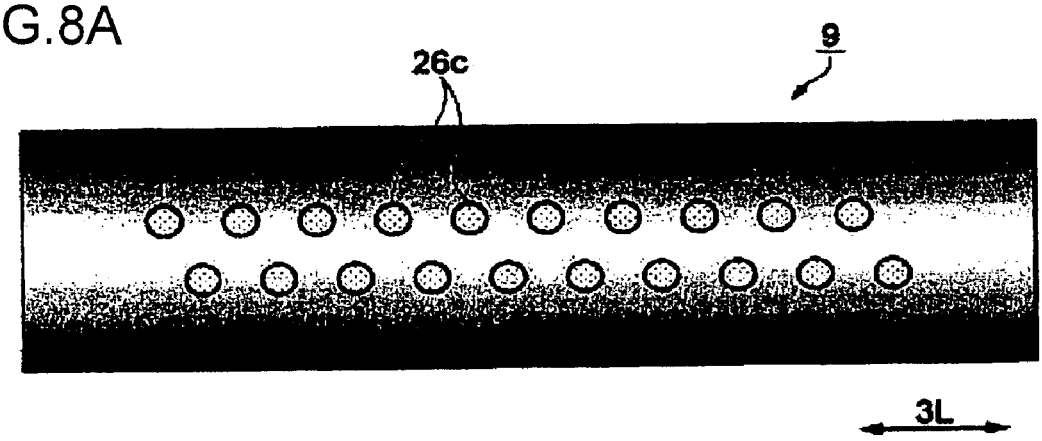
FIGS. 8A to 8C are schematic views for explaining images of light from a light-emitting pixel at a surface of a photoconductor drum.
Figure 8B:
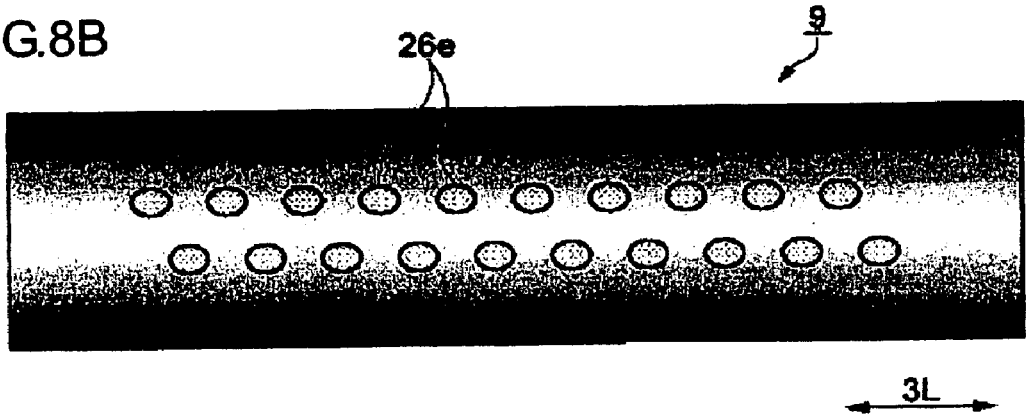
Figure 8C:
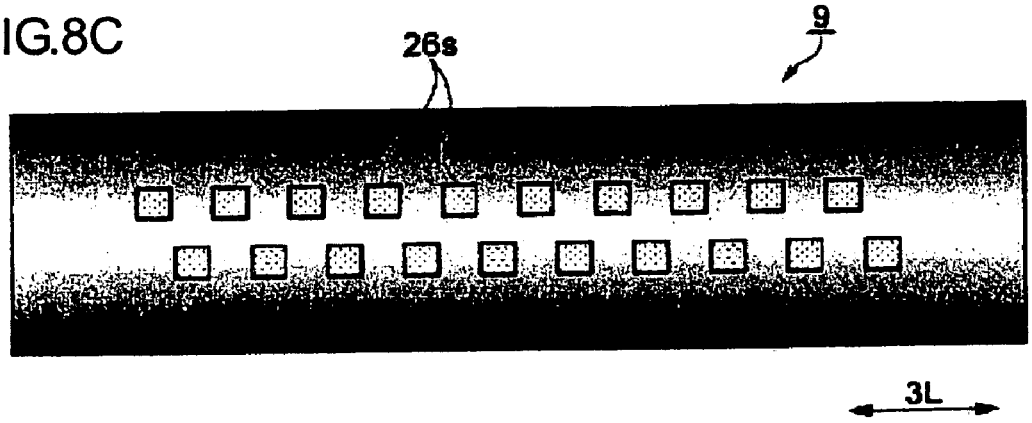

By employing such a shape and arrangement, light emitted from each of the organic EL elements 3 and condensed by the condensing lens 58, that is, the light whose image is formed on the photoconductor drum 9 has, for example, a circular shape, a square shape, or a similar shape, which are shown in FIG. 8. Referring to FIG. 8A, images 26*c* on the surface of the photoconductor drum 9 are shown such that the light-emitting pixels 25*b* correspond to images 26*c* in the case of the elliptical shape shown in FIG. 7B or the elliptical shape shown in FIG. 7A, and the images 26*c* are formed in a substantially circular shape. Here, the image 26*c* may have an elliptical shape whose long axis is parallel to the arrangement direction 3L of the light-emitting pixel 25*b*, which corresponds to the images 26*e* shown in FIG. 8B. In addition, FIG. 8C shows images 26*s* on the surface of the photoconductor drum 9 when the light-emitting pixel 25*b* has a rectangular shape as shown in FIG. 7C, and the image 26*s* is formed in a substantially rectangular shape.

In this way, light from the light-emitting pixel 25*b* is condensed in a long axis direction of the light-emitting pixel, and the condensed light is irradiated on the photoconductor drum 9. According to an experiment of the inventors, light from the elliptical light-emitting pixel 25*b* having a length of 100 μm in its long axis direction and a length of 50 μm in its short axis direction could be condensed in a circular shape having a diameter of 50 μm on the photoconductor drum 9. At this time, a luminance two times as large as the luminance of the light-emitting pixel 25*b* on the photoconductor drum 9 was obtained.

In addition, an aspect ratio of the light-emitting pixels is variously adjusted for each of the light-emitting pixels 25*b* described above, so that if the aspect ratio is made to be almost equal to a ratio of a brightness (luminance) required on the photoconductor drum 9 to a brightness (luminance) at each of the light-emitting pixels 25*b* of the organic EL elements 3, a desired brightness (luminance) on the photoconductor drum 9 can be obtained by making light emitted from each of the light-emitting pixels 25*b* condensed with the condensing lens. Accordingly, by properly setting the condensing degree of the condensing lens 58 and the aspect ratio of the light-emitting pixels 25*b* in advance, a desired and good luminance (amount of light) can be obtained by condensing light with the condensing lens 58 even for the organic EL elements having a relatively low luminance (amount of light).

As described above, the circuit part 11 is disposed beneath the organic EL element 3. The circuit part 11 is formed on the element substrate 2. That is, a ground surface protective layer 281 having SiO2 as a main constituent is formed as a ground surface on the surface of the element substrate 2, and a silicon layer 241 is formed on the ground surface. A gate insulating layer 282 having SiO2 and/or SiN as main constituents is formed on the surface of the silicon layer 241.

In the silicon layer 241, an area where the gate electrode 242 is overlapped by inserting the gate-insulating layer 282 is set to be a channel area 241*a*. The gate electrode 242 is a scan line portion. Next, a first interlayer insulating layer 283 having SiO2 as a main constituent is formed on the surface of the gate insulating layer 282 which covers the silicon layer 241 and forms the gate electrode 242.

Further, in the silicon layer 241, while a lightly doped source region 241*b* and a heavily doped source region 241S are formed at the source side of the channel area 241*a*, a lightly doped drain region 241*c* and a heavily doped drain region 241D are formed at the drain side of the channel area 241*a* and a so-called lightly doped drain (LDD) structure is realized. Among these, the heavily doped source region 241S is connected to a source electrode 243 via a contact hole 243*a*, which is formed along the gate insulating layer 282 and the first interlayer insulating layer 283. The source electrode 243 is constructed as a portion of a power supply line (not shown). On the other hand, the heavily doped drain region 241D is connected to a drain electrode 244 consisting of the same layer as the source electrode 243 via a contact hole 244*a* which is open along the gate insulating layer 282 and the first interlayer insulating layer 283.

A planarized film 284 having, for example, an acryl resin or the like as a main constituent is formed on an upper layer of the first interlayer insulating layer 283 where the source electrode 243 and the drain electrode 244 are formed. The planarized film 284 is formed of resins having heat resistance and insulation properties such as acryl, and polyimide is known to be able to be formed so as to eliminate concavity and convexity of the surface made by the TFT 123 (driving element 4) for driving or the source electrode 243 and the drain electrode 244 or the like.

The pixel electrode 23 consisting of ITO or the like is formed on the surface of the planarized film 284 and is connected to the drain electrode 244 via the contact hole 23*a* formed in the planarized film 284. That is, the pixel electrode 23 is connected to the heavily doped drain region 241D of the silicon layer 241 via the drain electrode 244.

The pixel electrode 23 and the aforementioned inorganic partition wall 25 are formed on the surface of the planarized film 284 on which the pixel electrode 23 is formed, moreover, an organic partition wall 221 is formed on the inorganic partition wall 25. The hole transporting layer 70 and the light-emitting layer 60 are laminated inside of the aperture 25*a* formed in the inorganic partition wall 25 and an aperture 221*a* formed in the organic partition wall 221, that is, in a pixel area. The hole transporting layer 70 and the light-emitting layer 60 are laminated in order, from the pixel electrode 23 side. In this way, the function layer is formed.

In addition, the driving elements 4 such as the TFT are mounted on the element substrate 2 as the elements for driving the organic EL elements 3 in this embodiment, however, the driving elements 4 may not be mounted on the element substrate 2 but may be externally mounted. To be more specific, a driver IC may be mounted on the terminal region of the element substrate 2 in a chip-on-glass (COG) manner, or a flexible circuit substrate having the driver IC mounted therein may be mounted on the element substrate 2.

Next, a type of usage of the line head module 101 will be described.

Figure 9:
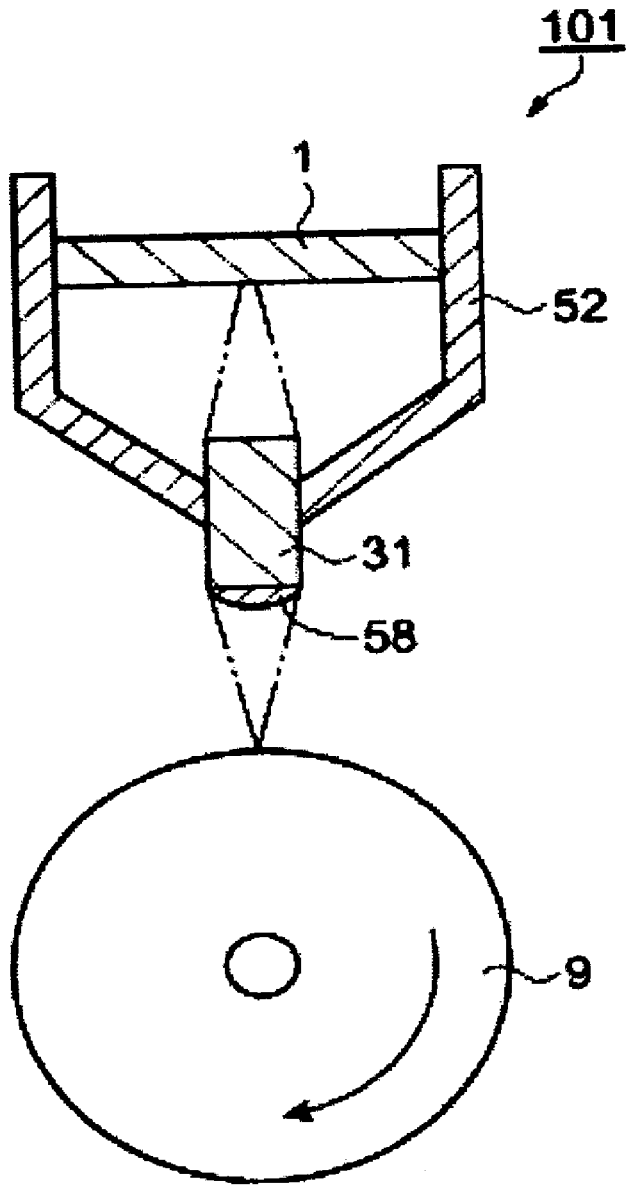
FIG. 9 is a schematic view for explaining a type of usage of a line head module.

FIG. 9 is a view illustrating the type of usage of the line head module 101 in the image forming apparatus to be described later. As shown in FIG. 9, the line head module 101 irradiates light on the photoconductor drum 9 serving as an exposed part and forms an image of light thereon so as to expose the photoconductor drum. In this case, the line head 1, is aligned such that the arrangement direction 3L of the organic EL elements 3 is parallel to the rotational axis of the photoconductor drum 9. In addition, the line head 1, the lens array 31, and the condensing lens 58 are integrated with the head case 52 while the line head 1, the lens array 31, and the condensing lens 58 are aligned with one another as described above. Therefore, simply aligning the line head module 101 with the photoconductor drum 9 is sufficient at the time of usage.

Accordingly, in this line head module 101, alignment of the line head 1, the lens array 31, and the condensing lens 58 to the photoconductor drum 9 is easily facilitated compared with a case of separately preparing the line head 1, the lens array 31, and the condensing lens 58, thus nonuniformity of exposure due to a poor alignment can be surely prevented.

In the line head module 101, since the condensing lens 58 condenses light only in a direction orthogonal to the arrangement direction 3L of the organic EL elements 3, interference of the light does not occur between the arranged organic EL elements 3 due to the light output from each of the organic EL elements 3 being made to permeate through the condensing lens 58, thereby separately condensing the light. Accordingly, the exposing function is not damaged so that a luminance (amount of light) of light output from the organic EL elements 3 increases, which thus increases practicability of the line head module 101 as an exposing unit, whereby printing performance of the image forming apparatus and the quality of the printed sheets can be improved.

Next, the image forming apparatus in which the line head module 101 of the invention is disposed will be described.

(Tandem Type Image Forming Apparatus)

Figure 10:
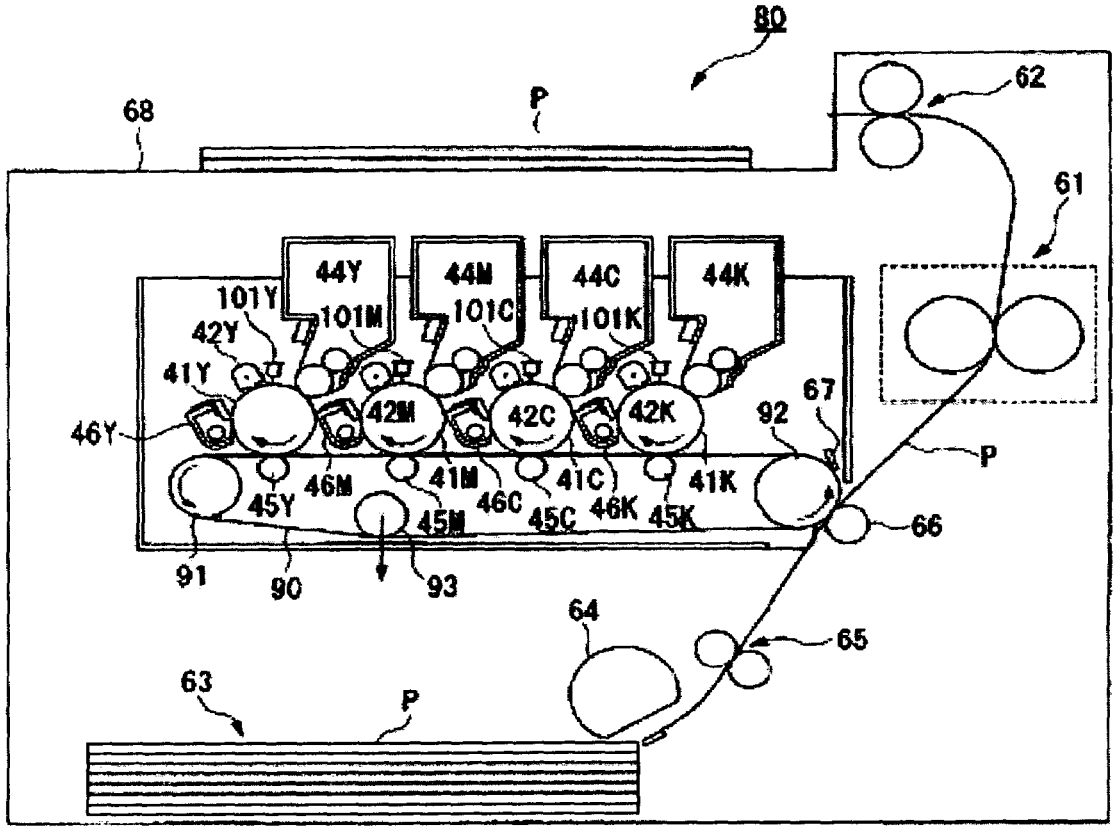
FIG. 10 is a schematic diagram illustrating an image forming apparatus in accordance with a first embodiment of the invention.

FIG. 10 is a schematic diagram of the tandem-type image forming apparatus, and the reference numeral 80 indicates the tandem-type image forming apparatus. The image forming apparatus 80 is constituted as a tandem type image forming apparatus 80 in which four line head modules 101K, 101C, 101M, and 101Y are arranged at exposing units of corresponding four photoconductor drums (image carriers) 41K, 41C, 41M, and 41Y with the same configuration.

The image forming apparatus 80 includes a driving roller 91, a driven roller 92, a tensioning roller 93, and an intermediate transfer belt 90 which is stretched over each roller and driven to be circulated in the direction (in the counterclockwise direction) indicated by an arrow in FIG. 10. The photoconductor drums 41K, 41C, 41M, and 41Y each having a photosensitive layer on its outer peripheral surface are arranged with a predetermined gap with respect to the intermediate transfer belt 90. The outer peripheral surface the photoconductor drums 41K, 41C, 41M, and 41Y are photoconductive layers as image carriers.

The characters K, C, M, and Y added to the reference numerals indicate black, cyan, magenta, and yellow, respectively. Thus, the photoconductor drums are for black, cyan, magenta, and yellow. These reference numerals are also applied to the other kinds of members. The photoconductor drums 41K, 41C, 41M, and 41Y are driven and rotated in the direction (clockwise direction) indicated by an arrow in FIG. 10, in synchronization with the driving of the intermediate transfer belt 90.

A charging unit (a corona charger) 42(K, C, M, or Y) for uniformly charging the outer peripheral surface of the photoconductor drum 41 (K, C, M, or Y), and the line head module 101 of the invention (K, C, M, or Y) for sequentially scanning the outer peripheral surface uniformly charged by the charging unit 42 (K, C, M, or Y), in synchronization with the rotation of the photoconductor drum 41 (K, C, M, or Y), are arranged around each photoconductor drum 41 (K, C, M, or Y).

Here, the line head module 101 (K, C, M, or Y) is integrated by the head case 52 while the line head 1, the lens array 31, and the condensing lens 58 are aligned to one another as described above.

The image forming apparatus is provided with a developing unit 44(K, C, M, or Y) for imparting toner, serving as a developer, onto an electrostatic latent image formed by the line head module 101 (K, C, M, or Y) thereby for converting the image into a visible image (toner image), a primary transfer roller 45 (K, C, M, or Y) as a primary transfer unit for sequentially transferring the toner image developed by the developing unit 44 (K, C, M, or Y) onto the intermediate transfer belt 90, that is a primary transfer target, and a cleaning unit 46 (K, C, M, or Y) for removing toner remaining on the surface of the photoconductor drum 41 (K, C, M, or Y) after the transfer.

In this case, each line head module 101 (K, C, M, or Y) is arranged such that the arrayed direction (the arrangement direction 3L of the organic EL element 3) of each line head 1 is parallel to the rotational axis of the photoconductor drum 41 (K, C, M, or Y). Further, the light emission energy peak wavelength of each line head module 101 (K, C, M, or Y) is set to coincide approximately with the sensitivity peak wavelength of each photoconductor drum 41 (K, C, M, or Y).

In the developing unit 44(K, C, M, or Y), for example, a non-magnetic single-component toner is used as the developer. The single-component developer is conveyed to a developing roller by, for example, a supplying roller. The film thickness of the developer adhered to the surface of the developing roller is regulated by a control blade. Then, the developing roller is brought into contact with or pressed against the photoconductor drum 41 (K, C, M, or Y), so as to cause the developer to be adhered thereto depending on the potential level on the photoconductor drum 41 (K, C, M, or Y), so that development into a toner image is performed.

The four toner images of black, cyan, magenta, and yellow generated by such four single-color toner image forming stations are primarily transferred sequentially onto the intermediate transfer belt 90 owing to a primary transfer bias applied on each primary transfer roller 45 (K, C, M or Y). A full-color toner image generated by overlaying these single-color toner images on the intermediate transfer belt 90 is secondarily transferred onto a recording medium P, such as a paper sheet, at a secondary transfer roller 66. The image is fixed on the recording medium P during the passage through a pair of fixing rollers 61, serving as a fixing unit. The recording medium P is then ejected through a pair of sheet ejection rollers 62 onto a sheet ejection tray 68 provided on the top of the device.

Furthermore, in FIG. 10, reference numeral 63 indicates a sheet feed cassette for holding a stack of a large number of recording media P. Reference numeral 64 indicates a pick-up roller for feeding the recording medium P one by one from the sheet feed cassette 63. Reference numeral 65 indicates a pair of gate rollers for defining the timing of feeding the recording medium P to a secondary transfer section of the secondary transfer roller 66. Reference numeral 66 indicates the secondary transfer roller serving as a secondary transfer unit forming a second transfer part between the secondary transfer roller 66 and the intermediate transfer belt 90. Reference numeral 67 indicates a cleaning blade serving as a cleaning unit for removing the toner remaining on the surface of the intermediate transfer belt 90 after the secondary transfer.

(Four-Cycle-Type Image Forming Apparatus)

Figure 11:
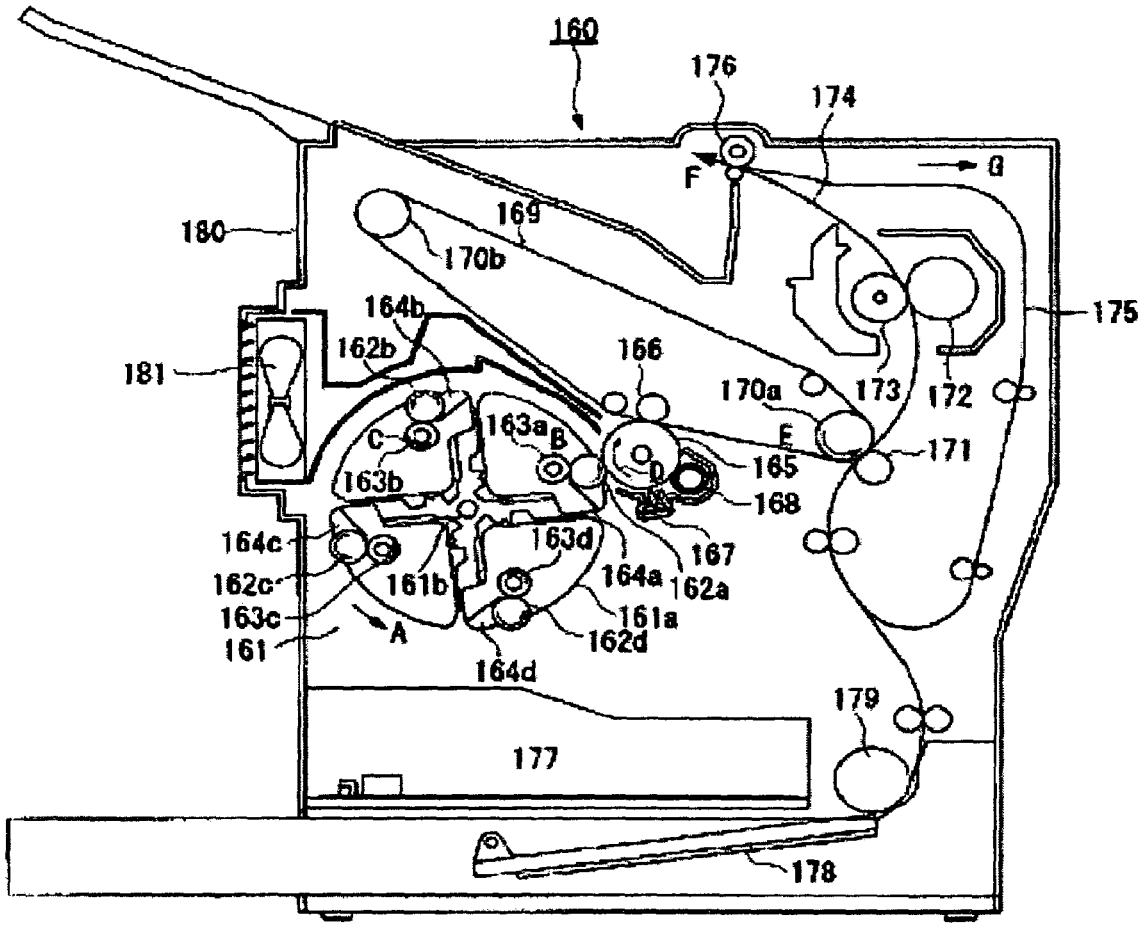
FIG. 11 is a schematic diagram illustrating an image forming apparatus in accordance with a second embodiment of the invention.

Next, a four-cycle-type image forming apparatus will be described. FIG. 11 is a longitudinal side view of the image forming apparatus of a four-cycle system, and reference numeral 160 indicates the four-cycle-type image forming apparatus. As shown in FIG. 11, this image forming apparatus 160 includes a developing unit 161 having rotary arrangement, a photoconductor drum 165 functioning as an image carrier, an image writing unit 167 (an exposing unit) composed of the aforementioned line head modules, an intermediate transfer belt 169, a sheet conveying path 174, a heating roller 172 of a fixing device, and a sheet feeding tray 178.

In the developing unit 161, a developing rotary 161*a* turns in the direction indicated by an arrow A about a shaft 161*b*. The inside of the developing rotary 161*a* is divided into four sections each provided with one of the image forming units for four colors of yellow (Y), cyan (C), magenta (M), and black (K). Reference numerals 162*a* to 162*d* indicate developing rollers each arranged in each of the image forming units for four colors and rotating in the direction indicated by an arrow B. Reference numerals 163*a* to 163*d* indicate toner supply rollers rotating in the direction indicated by an arrow C. Reference numerals 164*a* to 164*d* indicate control blades for regulating the toner thickness to a predetermined value.

In FIG. 11, reference numeral 165 indicates a photoconductor drum functioning as an image carrier as described above, reference numeral 166 indicates a primary transfer member, reference numeral 168 indicates a charger. Reference numeral 167 indicates an image-writing unit composed of the lined head modules, serving as the exposing unit of the invention. Further, the photoconductor drum 165 is driven by a driving motor (not shown), such as a stepping motor, in a direction indicated by an arrow D, which is reverse to the rotating direction of the developing roller 162*a*. The line head modules constituting the image-writing unit 167 are arranged while they are aligned between the image-writing unit and the photoconductor drum 165.

The intermediate transfer belt 169 is stretched over a driving roller 170*a* and a driven roller 170*b*. The driving roller 170*a* is linked to a driving motor of the photoconductor drum 165 so as to transmit power to the intermediate transfer belt 169. When this driving motor operates, the driving roller 170*a* of the intermediate transfer belt 169 rotates in the direction indicated by an arrow E, which is reverse to the rotating direction of the photoconductor drum 165.

The sheet conveying path 174 is provided with a plurality of conveying rollers and a pair of sheet ejection rollers 176 so as to convey a paper sheet. An image (toner image) on one side carried by the intermediate transfer belt 169 is transferred to one side of the paper sheet at the position of the secondary transfer roller 171. The secondary transfer roller 171 is brought into contact with or separated from the intermediate transfer belt 169 by a clutch mechanism. When the clutch operates, the secondary transfer roller 171 is brought into contact with or separated from the intermediate transfer belt 169, thus the image is transferred to the paper sheet.

The paper sheet carrying the image transferred as described above undergoes a fixing process in the fixing device having a fixing heater. The fixing device is provided with a heating roller 172 and a pressure roller 173. The paper sheet after the fixing process is drawn into the pair of sheet ejection rollers 176 to travel in the direction indicated by an arrow F. In this state, when the pair of sheet ejection rollers 176 turns reversely, the paper sheet travels reversely in the direction indicated by an arrow G through a sheet conveying path 175 for double-side printing. Reference numeral 177 indicates an electric equipment box. Reference numeral 178 indicates a sheet feeding tray for housing paper sheets. Reference numeral 179 indicates a pick-up roller provided at the exit of the sheet feeding tray 178.

The driving motor used for driving the conveying rollers in the sheet conveying path is, for example, a low-speed brushless motor. A stepping motor is used for the intermediate transfer belt 169 because of the necessity of color shift correction. Each of the motors is controlled by signals provided from a controller, which is not shown.

In the state shown in FIG. 11, an electrostatic latent image of yellow (Y) is formed on the photoconductor drum 165, and a high voltage is applied to the developing roller 162*a*. As a result, an image of yellow is formed on the photoconductor drum 165. When both the rear side image and the front side image of yellow are carried by the intermediate transfer belt 169, the developing rotary 161*a* turns by 90 degrees in the direction indicated by the arrow A.

The intermediate transfer belt 169 makes one turn, and returns to the position of the photoconductor drum 165. Next, the two sides of images of cyan (C) are formed on the photoconductor drum 165. These images are then overlaid on the image of yellow carried on the intermediate transfer belt 169. Thereafter, similar processes are repeated. That is, the developing rotary 161 turns by 90 degrees, and then the intermediate transfer belt 169 makes one turn after the images are carried to the intermediate transfer belt 169.

In order that all the images of four colors are transferred to the intermediate transfer belt 169, the intermediate transfer belt 169 needs to makes four turns. Thereafter, the turning position is controlled so that the images are transferred to a paper sheet at the position of the secondary transfer roller 171. A paper sheet fed from the sheet feeding tray 178 is conveyed in the conveying path 174, and then the color images is transferred to one side of the paper sheet at the position of the secondary transfer roller 171. The paper sheet having the transferred image on one side thereof is reversed by the pair of sheet ejection rollers 176 as described above, and then waits in the conveying path. Thereafter, at an appropriate timing, the paper sheet is conveyed to the position of the secondary transfer roller 171, so that the other color image is transferred to the other side. A housing 180 is provided with an exhaust fan 181.

The image forming apparatuses 80 and 160 shown in FIGS. 10 and 11 have the line head module 101 of the invention shown in FIG. 1 as an exposing unit.

Accordingly, the line head module 101 enhances the luminance (amount of light) of light emitted from the light-emitting elements in these image forming apparatus 80 and 160 as described above, thus practicability of the line head module as the exposing unit is improved, which improves printing performance of the image forming apparatus and the quality of the printed sheets.

In addition, the image forming apparatus having the line head of the invention is not limited to the above-described embodiment, but may be variously modified.

The embodiment of the invention has been described, however, various changes may be applied to the embodiments without departing from the spirit of the invention. The modifications are, for example, as follows.

First Modification

The condensing lens 58 is attached to a surface of the lens array 31 facing the photoconductor drum 9 in the above-described embodiment, however, the condensing lens 58 may be disposed between the lens array 31 and the photoconductor drum 9 instead. A type of usage of the line head module in this case is shown in FIG. 12.

Figure 12:
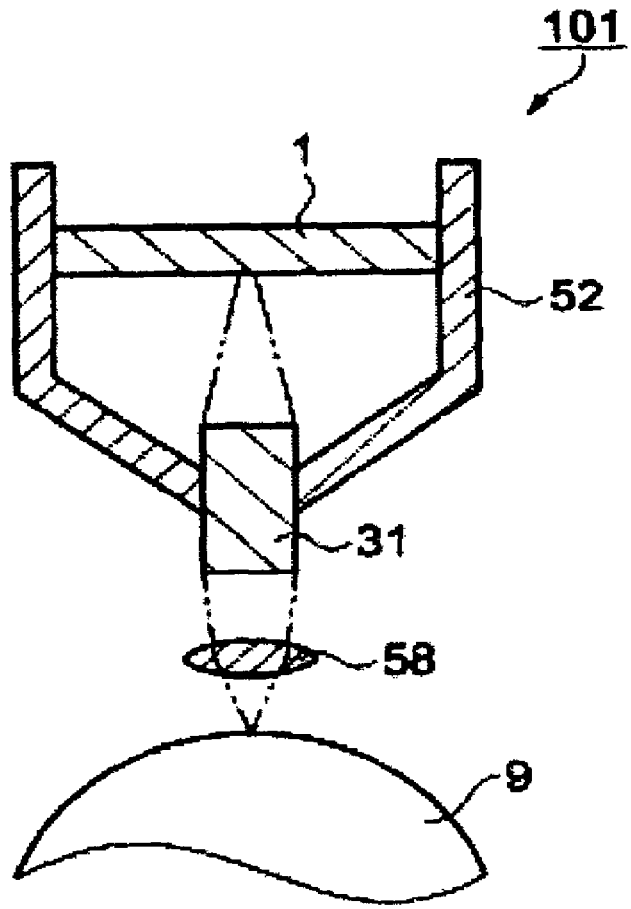
FIG. 12 is a schematic diagram for explaining a type of usage of a line head module in accordance with a first modification.

As shown in FIG. 12, a double-convex lens may be adopted as the condensing lens 58 since the condensing lens 58 is not in contact with any of the lens array 31 and the photoconductor drum 9. Therefore, a lens having a radius of curvature larger than the vault shaped lens shown in the embodiment can be used, and the condensing lens 58 can be made thin. The condensing lens 58 may be fixed by any methods as long as its relative position to the lens array 31 does not change. For example, the condensing lens 58 may be indirectly fixed to the head case 52 by means of a supporting member.

The line head module 101 having the above-described structure can condense light output from the respective organic EL elements 3 in the long axis direction of the light-emitting pixels 25*b* by means of the condensing lens 58. By means of this structure, images of the light-emitting pixels 25*b* on the surface of the photoconductor drum 9 can be condensed in a substantially circle or square shape, and the luminance on the surface of the photoconductor drum 9 can be enhanced to be brighter than the luminance at the light-emitting pixels 25*b*. In addition, practicability of the line head module 101 as the exposing unit is improved, which allows the performance of the printing function of the image forming apparatus and the quality of the printed sheets.

Second Modification

Instead of the constructions shown in the respective embodiments, the condensing lens 58 may be disposed between the line head 1 and the lens array 31. A type of usage of the line head module 101 having the structure is shown in FIG. 13.

Figure 13A:
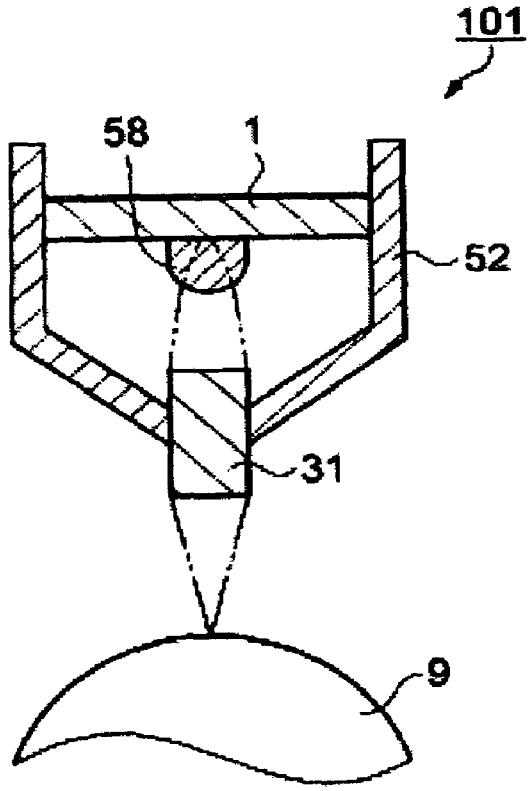
FIG. 13 is a schematic diagram for explaining a type of usage of a line head module in accordance with a second modification.

FIG. 13A shows the line head module 101 having a construction in which the condensing lens 58 is attached to a portion corresponding to the light-emitting element row 3A of the line head 1. Referring to FIG. 13A, the condensing lens 58 is a vault shaped lens whose one surface is flat. The condensing lens 58 is attached to the line head 1 while the pane is in contact with each other. Here, a radius of curvature at a portion corresponding to the optical path on the surface of the condensing lens 58 is made smaller than the distance from the light-emitting pixels 25*b* to the condensing lens 58, in order to effectively condensing light.

Even in the line head module 101 having such a construction, light output from the respective organic EL elements 3 can be condensed in the long axis direction of the light-emitting pixels 25*b* by means of the condensing lens 58. Therefore, images of the light-emitting pixels 25*b* on the surface of the photoconductor drum 9 can be condensed in a substantially circle or square shape, and the luminance on the surface of the photoconductor drum 9 can be enhanced to be brighter than the luminance at the light-emitting pixels 25*b*.

Figure 13B:
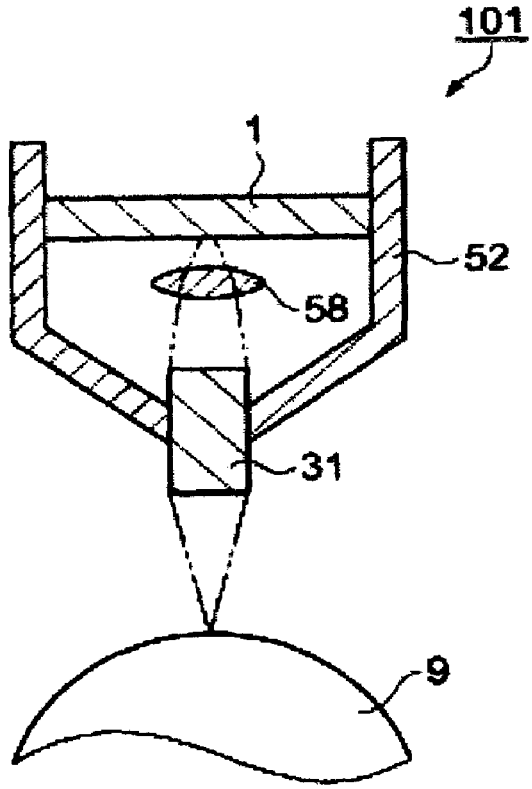

FIG. 13B shows the line head module 101 having a construction in which the condensing lens 58 is disposed at an intermediate position between the line head 1 and the lens array 31. Referring to FIG. 13B, the condensing lens 58 is a double-convex lens, and a lens having a radius of curvature larger than the condensing lens 58 of FIG. 13A can be used, and the condensing lens 58 can be made thin. In addition, the condensing lens 58 is indirectly fixed to the head case 52 by means of a supporting member. In this case, the condensing lens 58 is preferably disposed close to the light-emitting pixels 25*b* such that an angle of incident light is widened, in order to enhance the luminance on the surface of the photoconductor drum 9.

Even in the line head module 101 having such a structure, light output from the respective organic EL elements 3 can be condensed in the long axis direction of the light-emitting pixels 25*b* by means of the condensing lens 58. By this, images of the light-emitting pixels 25*b* on the surface of the photoconductor drum 9 can be condensed in a substantially circle or square shape, and the luminance on the surface of the photoconductor drum 9 can be enhanced to be brighter than the luminance at the light-emitting pixels 25*b*.

Third Modification

Instead of the embodiments and the modifications, a construction having a plurality of condensing lenses 58 may be employed. A type of usage of the line head module 101 having such a construction is shown in FIG. 14.

Figure 14A:
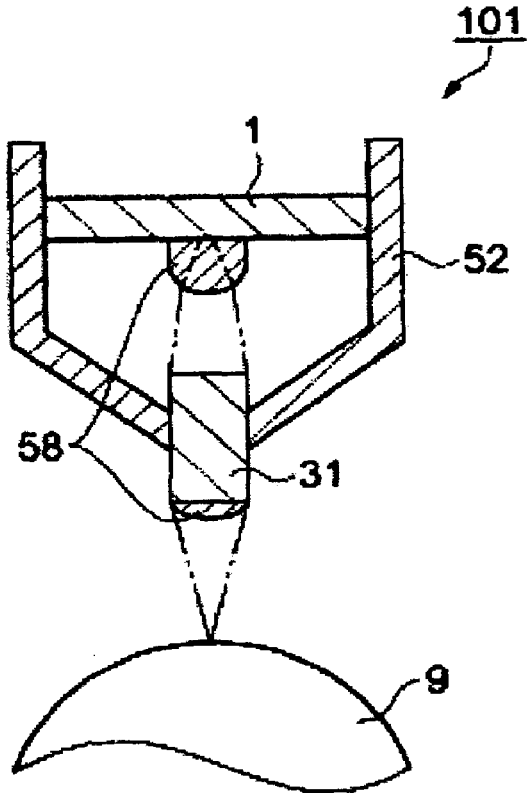
FIG. 14 is a schematic diagram for explaining a type of usage of a line head module in accordance with a third modification.

FIG. 14A shows the line head module 101 having a construction in which the condensing lenses 58 are attached to the surface of the lens array 31 facing the photoconductor drum 9 and to a portion corresponding to the light-emitting element row 3A of the line head 1, respectively. Referring to FIG. 14A, all of the condensing lenses 58 are vault shaped lenses whose one surface is flat, and the condensing lenses 58 are attached to the line head 1 or the lens array 31 while the surfaces are in contact with the line head or the lens array.

According to the line head module 101 having such a construction, light output from the respective organic EL elements 3 can be condensed in the long axis direction of the light-emitting pixels 25*b* by means of the two condensing lenses 58. By this construction, images of the light-emitting pixels 25*b* on the surface of the photoconductor drum 9 can be condensed in a substantially circle or square shape, and the luminance on the surface of the photoconductor drum 9 can be enhanced to be brighter than the luminance at the light-emitting pixels 25*b*. In this case, light can be effectively condensed as compared with a case of condensing light by means of a single condensing lens 58. In addition, a radius of curvature of each of the condensing lenses 58 can made large, and the condensing lenses 58 can be made thin.

Figure 14B:
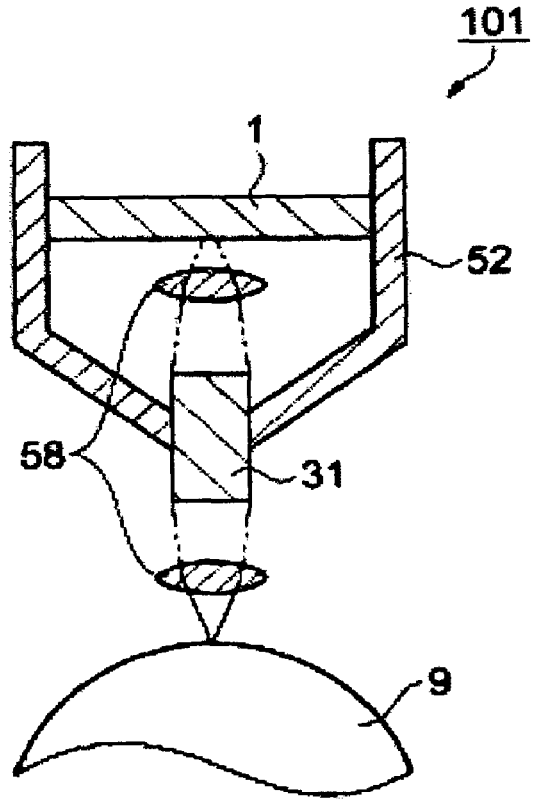

In addition, as shown in FIG. 14B, the condensing lenses 58 may be disposed at an intermediate position between the line head 1 and the lens array 31, and at an intermediate position between the lens array 31 and the photoconductor drum 9. Referring to FIG. 14B, both of the condensing lenses 58 are double-convex lenses, and are indirectly fixed to the head case 52 by means of a supporting member.

Even in the line head module 101 having such a construction, light output from the respective organic EL elements 3 can be condensed in the long axis direction of the light-emitting pixels 25*b* by means of the two condensing lenses 58. Therefore, images of the light-emitting pixels 25*b* on the surface of the photoconductor drum 9 can be condensed in a substantially circle or square shape, and the luminance on the surface of the photoconductor drum 9 can be enhanced to be brighter than the luminance at the light-emitting pixels 25*b*.

Besides these constructions, a construction in which a double-convex lens may be used as any one of the condensing lenses 58 shown in FIG. 14A to be indirectly fixed to the head case 52 by means of a supporting member, or a construction in which a vault shaped lens may be used as any one of the condensing lenses 58 shown in FIG. 14B to be attached to the line head 1 or the lens array 31, which can also obtain the same effects.

Fourth Modification

Alternatively, instead of the respective embodiments and the modifications, a construction having the condensing lenses 58 more than three may be employed. A type of usage of the line head module 101 having this construction is shown in FIG. 15.

Figure 15:
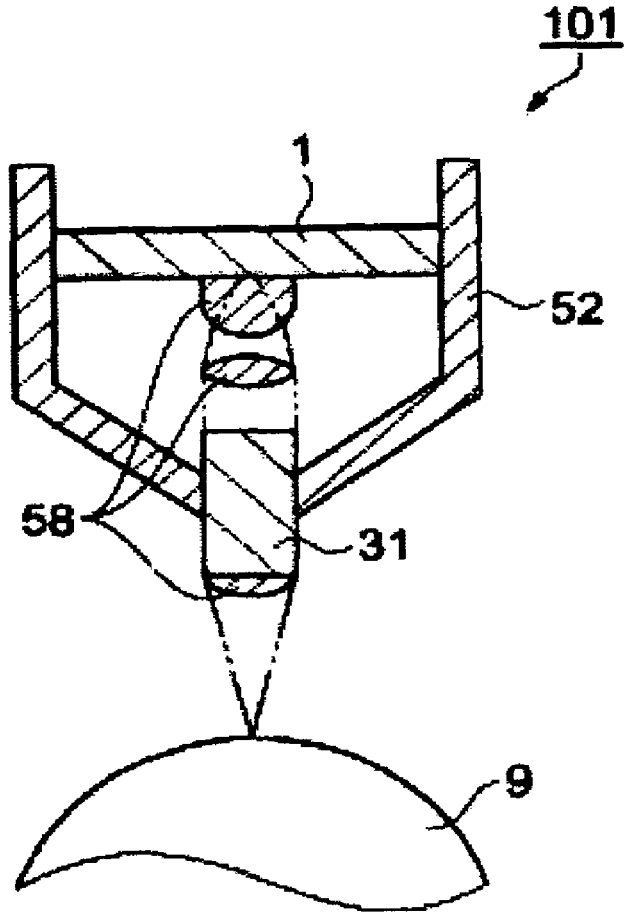
FIG. 15 is a schematic diagram for explaining a type of usage of a line head module in accordance with a fourth modification.

FIG. 15 shows the line head module 101 having three condensing lenses 58 in total at portions corresponding to the light-emitting element row 3A of the line head 1, at a space between the line head 1 and the lens array 31, and at a surface of the lens array 31 facing the photoconductor drum 9. According to the line head module 101 having this construction, light output from the respective organic EL elements 3 can be more effectively condensed in the long axis direction of the light-emitting pixels 25*b* by means of the three condensing lenses 58. Therefore, images of the light-emitting pixels 25*b* on the surface of the photoconductor drum 9 can be condensed in a substantially circle or square shape, and the luminance on the surface of the photoconductor drum 9 can be enhanced to be brighter than the luminance at the light-emitting pixels 25*b*. In this case, light can be more effectively condensed as compared with the cases of condensing light by means of the single or two condensing lenses 58. In addition, a radius of curvature of the respective condensing lenses 58 can be made large, and the condensing lenses 58 can be made thin.

In this case, where the respective condensing lenses 58 are disposed is not limited to those locations shown in FIG. 15. For example, but a surface of the lens array 31 facing the line head 1, or a space between the lens array 31 and the photoconductor drum 9 may substitute for those locations. Alternatively, more than four of the condensing lenses 58 may be disposed.

Fifth Modification

Figure 16A:
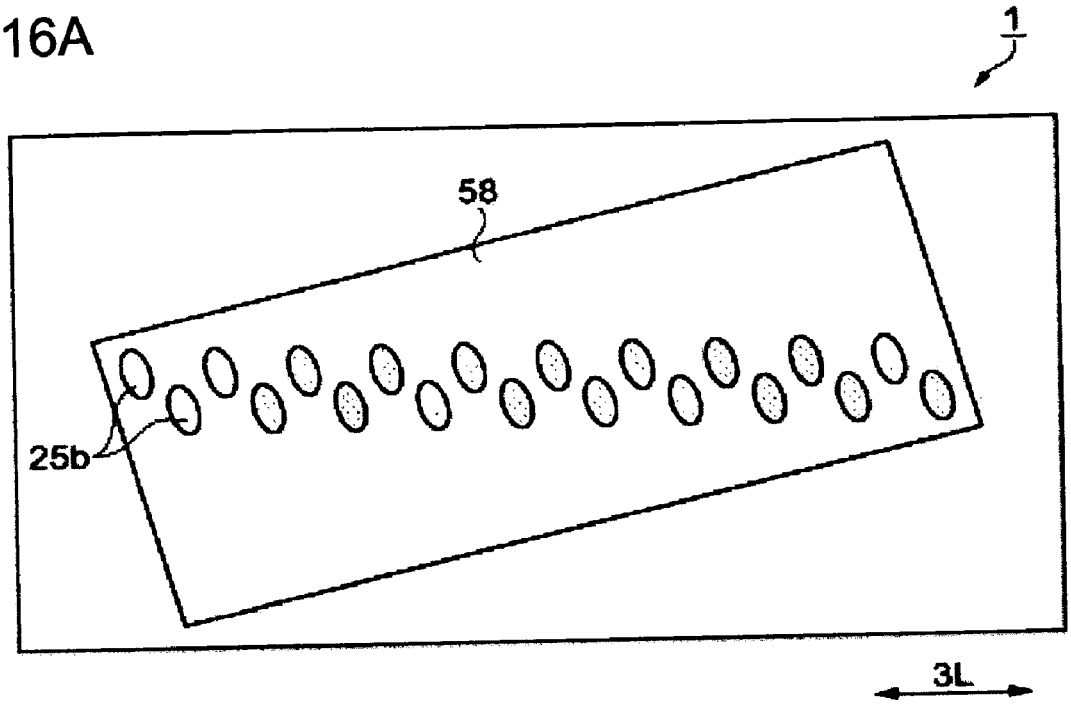
FIG. 16 is a plan view illustrating a line head in accordance with a fifth modification.
Figure 16B:
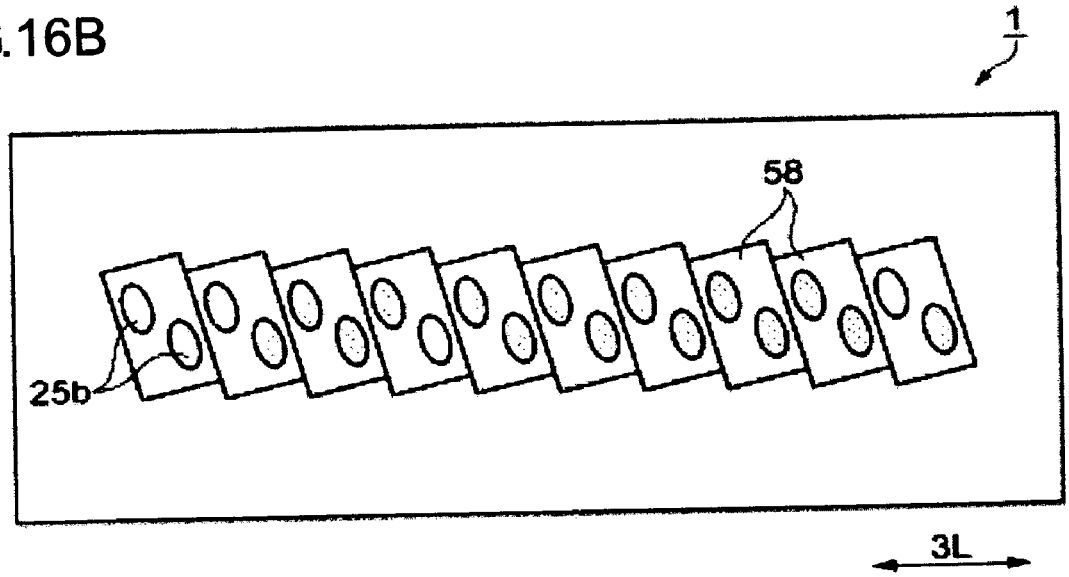

In the respective embodiments, the light-emitting pixels 25*b* are disposed such that the short axis and the long axis thereof are disposed parallel to the long axis direction and the short axis direction of the line head 1; however, the short and long axes may be disposed tilted by a predetermined angle to the respective axis directions of the line head 1. A plan view of such a line head 1 is shown in FIGS. 16A and 16B. Referring to FIGS. 16A and 16B, the arrangement direction 3L of the light-emitting pixels 25*b* is parallel to the long axis direction of the line head 1, however, the short axis and the long axis of the respective light-emitting pixels 25*b* are not parallel to the long axis direction and the short axis direction of the line head 1, respectively.

In order to condense light emitted from the light-emitting pixels 25*b* in the long axis direction in the same manner as the respective embodiments, the vault shaped condensing lens 58 is preferably disposed such that the generatrix of the condensing lens 58 is parallel to the short axis direction of the light-emitting pixels 25*b* and the condensing lens 58 covers all of the light-emitting pixels 25*b* as shown in FIG. 16A. Even in this construction, light of the light-emitting pixels 25*b* is condensed in the long axis direction. Consequently, images of the light-emitting pixels 25*b* on the surface of the photoconductor drum 9 can be condensed in a substantially circle or square shape, and the luminance on the surface of the photoconductor drum 9 can be enhanced to be brighter than the luminance at the light-emitting pixels 25*b*.

In addition, the condensing lens 58 may be disposed with one light-emitting pixel 25*b*, or two or more of the light-emitting pixels 25*b*. FIG. 16B shows that a case that the condensing lens 58 is disposed with every two light-emitting pixels 25*b*, and each of the condensing lenses 58 is disposed so as to condense light emitted from the light-emitting pixels 25*b* in the long axis direction.

Sixth Modification

In the above-described embodiment, the organic EL elements 3 (or inorganic EL elements) are used as the light-emitting elements in the line head 1. However, light-emitting diodes may be employed as the light-emitting elements instead.

What is claimed is:

1. A line head module which faces a photoconductor drum and is disposed such that light-emitting elements are arranged parallel to a rotational axis of the photoconductor drum to carry out exposure on the photoconductor drum, the photoconductor drum being rotatably disposed, comprising:

a line head having the plurality of light-emitting elements; and a condensing lens that condenses light in a direction crossing the arrangement direction of the light-emitting elements between the photoconductor drum and the side of the line head from which light is output, wherein each of light-emitting pixels of the light-emitting elements is formed so as to be longer in a direction crossing the arrangement direction than in the arrangement direction of the light-emitting elements.

2. The line head module according to claim 1, wherein the light-emitting elements are electroluminescent (EL) elements.

3. The line head module according to claim 1, wherein each of the light-emitting pixels has a rectangular shape.

4. The line head module according to claim 1, wherein the condensing lens condenses light emitted from each of the light-emitting pixels on a surface of the photoconductor drum such that the length of the image of light in a direction orthogonal to the arrangement direction of the light-emitting elements is made equal to or less than the length in the image of light of the arrangement direction.

5. The line head module according to claim 1, wherein a ratio of the length in the arrangement direction of the light-emitting elements to the length in the direction crossing the arrangement direction of the light-emitting elements is almost the same as a ratio of brightness of the light-emitting pixel to brightness required on the surface of the photoconductor drum.

6. The line head module according to claim 1, wherein each of the light-emitting pixels of the light-emitting elements is formed so as to be longer in a direction substantially orthogonal to the arrangement direction than in the arrangement direction of the light-emitting elements, and the condensing lens condenses light in the direction substantially orthogonal to the arrangement direction of the light-emitting elements.

7. The line head module according to claim 1, wherein when the condensing lens is formed in a vault shape in which a surface of the condensing lens facing the photoconductor drum is convex toward the photoconductor drum and a surface of the condensing lens facing the line head is flat, the flat side of the condensing lens is attached to a side of a lens array from which light is output.

8. An image forming apparatus, comprising:

the line head module according to claim 1 as an exposing unit.

9. A line head module which faces a photoconductor drum and is disposed such that light-emitting elements are arranged parallel to a rotational axis of the photoconductor drum to carry out exposure on the photoconductor drum, the photoconductor drum being rotatably disposed, comprising:

a line head having the plurality of light-emitting elements;

a condensing lens that condenses light in a direction crossing the arrangement direction of the light-emitting elements between the photoconductor drum and the side of the line head from which light is output; and a lens array composed of lens elements which condense light from the light-emitting elements at the side of the line head from which light is output.

10. The line head module according to claim 9, wherein the condensing lens is provided between the line head and the lens array, and between the lens array and the photoconductor drum.

11. The line head module according to claim 9, wherein when the condensing lens is formed in a vault shape in which a surface of the condensing lens facing the photoconductor drum is convex toward the photoconductor drum and a surface of the condensing lens facing the line head is flat, the flat side of the condensing lens is attached to the side of the lens array from which light is output.

12. A line head module, comprising:

a plurality of light-emitting elements arranged to face a photoconductor drum which is rotatably disposed, wherein the light-emitting elements are arranged such that an arrangement direction of the light-emitting elements is parallel to a rotational axis of the photoconductor drum, a condensing lens is disposed at a side of the line head from which light is output, and light output from the line head condensed by the condensing lens is exposed to the photoconductor drum, and wherein each of light-emitting pixels of the light-emitting elements is formed so as to be longer in a direction crossing the arrangement direction than in the arrangement direction of the light-emitting elements.

13. The line head module according to claim 12, wherein the condensing lens condenses the light output from the line head in a direction crossing the arrangement direction of the light-emitting elements.

* * * * *